US010161135B2

(12) United States Patent
DeGraan

(10) Patent No.: US 10,161,135 B2
(45) Date of Patent: Dec. 25, 2018

(54) ROOF VENT ADAPTORS AND METHODS

(71) Applicant: Aztec Manufacturing, Inc., Poway, CA (US)

(72) Inventor: Matthew DeGraan, Poway, CA (US)

(73) Assignee: Aztec Manufacturing, Inc., Poway, CA (US)

( * ) Notice: Subject to any disclaimer, the term of this patent is extended or adjusted under 35 U.S.C. 154(b) by 0 days.

(21) Appl. No.: 15/787,382

(22) Filed: Oct. 18, 2017

(65) Prior Publication Data

US 2018/0112410 A1 Apr. 26, 2018

Related U.S. Application Data

(60) Provisional application No. 62/411,466, filed on Oct. 21, 2016, provisional application No. 62/421,174, filed on Nov. 11, 2016, provisional application No. 62/469,844, filed on Mar. 10, 2017.

(51) Int. Cl.

| | |
|---|---|
| ***E04D 13/14*** | (2006.01) |
| ***F24F 7/02*** | (2006.01) |
| ***E04D 1/36*** | (2006.01) |
| ***E04D 13/147*** | (2006.01) |
| *E04D 13/17* | (2006.01) |

(52) U.S. Cl.

CPC ..... *E04D 13/14* (2013.01); *E04D 1/36* (2013.01); *E04D 13/1473* (2013.01); *F24F 7/02* (2013.01); *E04D 13/1476* (2013.01); *E04D 13/17* (2013.01)

(58) Field of Classification Search

CPC ..... E04D 13/1476; E04D 13/1407; E04D 13/1475; E04D 13/147; E04D 1/36; E04D 13/143; E04D 13/14; E04D 13/1473; E04D 13/17; F24F 7/02

See application file for complete search history.

(56) References Cited

U.S. PATENT DOCUMENTS

| | | | | |
|---|---|---|---|---|
| 969,476 | A * | 9/1910 | Holt | E04D 13/1476 285/123.14 |
| 2,919,256 | A | 12/1959 | Wallgren et al. | |
| 3,368,835 | A * | 2/1968 | Hackforth | F16D 3/76 285/200 |
| 3,394,044 | A | 7/1968 | Granville | |
| 4,333,660 | A | 6/1982 | Cupit | |
| 4,462,190 | A | 7/1984 | Allen | |

(Continued)

OTHER PUBLICATIONS

International Search Report and Written Opinion in corresponding International Patent Application No. PCT/US2017/057247, dated Feb. 9, 2018, in 11 pages.

(Continued)

*Primary Examiner* — Andrew J Triggs

(74) *Attorney, Agent, or Firm* — Knobbe, Martens, Olson & Bear, LLP

(57) ABSTRACT

Various roof vent adaptors are disclosed. The roof vent adaptors can be used to seal penetrations on buildings, such as vent penetrations on metal or non-metal roofs. In various embodiments, the roof vent adaptor includes a sealing member, an outer securing unit and an inner securing unit. The roof vent adaptor can be secured to the roof to provide a generally liquid-tight seal around the roof vent, thereby inhibiting or preventing water intrusion into the building.

6 Claims, 25 Drawing Sheets

(56) References Cited

U.S. PATENT DOCUMENTS

| | | | | |
|---|---|---|---|---|
| 4,480,534 | A * | 11/1984 | Sloan | B65D 88/741 454/182 |
| 4,655,009 | A | 4/1987 | DeGraan | |
| 4,664,390 | A | 5/1987 | Horseman | |
| 4,750,301 | A | 6/1988 | Croxford | |
| 4,776,909 | A | 10/1988 | Bohm et al. | |
| 4,937,991 | A * | 7/1990 | Orth | E04D 13/1407 138/157 |
| 5,002,816 | A | 3/1991 | Hofmann et al. | |
| 5,414,964 | A | 5/1995 | Bodycomb | |
| 5,469,671 | A | 11/1995 | Rathgeber et al. | |
| 5,899,026 | A | 5/1999 | Williams et al. | |
| 5,961,244 | A | 10/1999 | Hahn | |
| 6,280,856 | B1 | 8/2001 | Andersen et al. | |
| 6,298,621 | B1 | 10/2001 | Lee | |
| 6,931,799 | B2 | 8/2005 | Webb | |
| 6,945,000 | B1 | 9/2005 | Hohmann et al. | |
| 7,892,077 | B2 | 2/2011 | Sattler et al. | |
| 8,209,923 | B1 | 7/2012 | Rich | |
| 8,596,004 | B2 | 12/2013 | Coulton et al. | |
| 9,255,412 | B2 | 2/2016 | Haynes | |
| 2004/0147661 | A1 | 7/2004 | Yaakub | |
| 2005/0055889 | A1 | 3/2005 | Thaler | |
| 2005/0144865 | A1 | 7/2005 | Ellingson | |
| 2009/0229193 | A1 | 9/2009 | Ellingson | |
| 2010/0285259 | A1 | 11/2010 | Bullock | |
| 2013/0328300 | A1 | 12/2013 | Bond | |
| 2014/0021713 | A1 * | 1/2014 | DeGraan | E04D 13/147 285/42 |
| 2018/0112410 | A1 * | 4/2018 | DeGraan | E04D 13/14 |

OTHER PUBLICATIONS

Aztec Washer Company, "Multi-Flash Square Vent Master Flash®" Flyer, Apr. 11, 2014, in 1 page.

* cited by examiner

667

669

666

668

ROOF VENT ADAPTORS AND METHODS

CROSS-REFERENCE

This application claims the priority benefit under 35 U.S.C. § 119 of U.S. Provisional Application No. 62/411,466, filed Oct. 21, 2016, U.S. Provisional Application No. 62/421,174, filed Nov. 11, 2016, and U.S. Provisional Application No. 62/469,844, filed Mar. 10, 2017. The entirety of each of the aforementioned applications is hereby incorporated by reference.

BACKGROUND

Field

This disclosure generally relates to seals for roof penetrations, such as sealing adaptors for vents on buildings with metal or non-metal roofs. The roof vent adaptor can provide a generally liquid-tight seal around the roof vent to inhibit or prevent water intrusion into the building.

Description of Certain Related Art

Roof penetrations are openings in a building's roof, typically to provide access for a system of the building. For example, some roof penetrations allow wires to be routed into the interior of the building to provide electrical power for the building. Some roof penetrations are for vents to allow airflow into or out of the building.

SUMMARY OF CERTAIN FEATURES

Roof penetrations can be problematic because they can be susceptible to leakage, such as by water or ambient air leaking through the roof penetration. This can result in damage to the building, costly maintenance, a reduction in the building's insulating efficiency, and/or a decrease in comfort for the building's occupants. Accordingly, proper sealing of a roof penetration is desirable.

Certain types of roofs, such as shingle style roofs, typically have a generally planar surface. This can facilitate sealing a roof penetration in such a roof, by allowing a flat seal to flushly engage with the generally planar roof surface of the roof. However, some roofs typically have a generally non-planar surface. For example, corrugated metal roofs may have a generally non-planar surface. Sealing roof penetrations in roofs with a generally non-planar surface can be difficult, ineffective, and/or time consuming because a flat seal may not mate flushly with the surface of the roof, which can allow gaps to remain between portions of the roof and the seal. Nevertheless, it is still desirable to be able to easily, effectively, and quickly seal off penetrations even in roofs with a generally non-planar surface, such as corrugated metal roofs.

This disclosure describes various roof vent adaptors that address at least one of the aforementioned issues, or other issues. In some embodiments, the roof vent adaptor includes a sealing member, such as a sheet of rubber. In some embodiments, the roof vent adaptor includes an outer securing band and/or an inner securing band, such as strips of metal around the outer and/or inner peripheries of the sealing member. In various embodiments, fasteners (e.g., screws) can be passed through the securing bands and secured to the roof. This can compress the sealing member between the roof surface and the securing bands, thereby providing a generally liquid-tight seal around the roof vent to inhibit or prevent water intrusion into the building. In various embodiments, the securing bands can distribute the pressure of the fasteners, which can reduce localized areas of high compression force, increase or strengthen the seal between the sealing member and the roof surface, and/or reduce the chance of the fasteners ripping or otherwise damaging the sealing member.

In certain implementations, the roof vent adaptor is configured to be placed over the roof vent. For example, the roof vent adaptor can be configured to be placed over the roof vent in a direction generally perpendicular to the roof surface. This can be helpful in applications where the roof vent is being newly installed, such as in new construction. In some implementations, the sealing member is substantially uniform, does not include a radially-extending opening, and/or is not configured to be expanded circumferentially (e.g., to wrap around a roof vent).

In certain variants, the roof vent adaptor is configured to be wrapped around the roof vent. For example, the roof vent adaptor can be configured to be mated with the roof vent in a direction generally parallel to the roof surface. This can be helpful in applications where the roof vent is already present, such as when retrofitting an existing roof vent. In some embodiments, the sealing member comprises an opening that extends radially between the aperture and the outer periphery of the sealing member. The opening can expand to enable the roof vent adaptor to be expanded circumferentially. The roof vent adaptor can then be wrapped around the roof vent and contracted circumferentially to engage with the roof vent.

Neither the preceding summary nor the following detailed description purports to limit or define the scope of protection. The scope of protection is defined by the claims.

BRIEF DESCRIPTION OF THE DRAWINGS

Various embodiments disclosed herein are described below with reference to the accompanying drawings. The illustrated embodiments are intended to illustrate, but not to limit the scope of this disclosure. Various features of the different disclosed embodiments can be combined to form further embodiments, which are part of this disclosure.

DETAILED DESCRIPTION OF CERTAIN EMBODIMENTS

Various improved roof vent adaptors are disclosed. The embodiments disclosed below are described in the context of a roof vent adaptor for sealing a vent in a metal roof, due to particular utility in that context. However, the inventions disclosed herein can also be applied to other types of roofs (e.g., wood, shingle, tar, or otherwise) and for sealing other types of penetrations or apertures (e.g., electrical conduits, drains, structural members, or otherwise). The roof vent adaptors can be configured for use on roofs that are pitched, such as gabled roofs, or non-pitched, such as flat roofs. Some embodiments are configured for use in non-roofing applications. For example, certain embodiments are configured to seal penetrations or apertures in walls, such as exterior walls with masonry or siding.

Figure 1B:
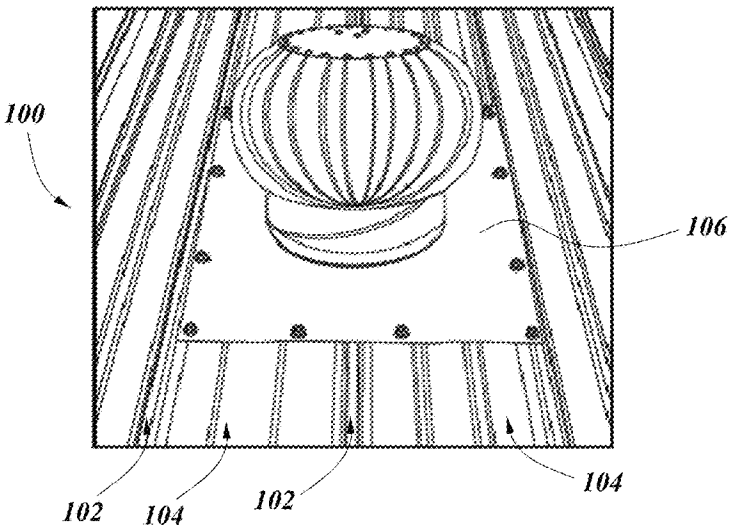
FIGS. 1A and 1B illustrate examples of corrugated metal roofs with roof vent penetrations.
Figure 1A:
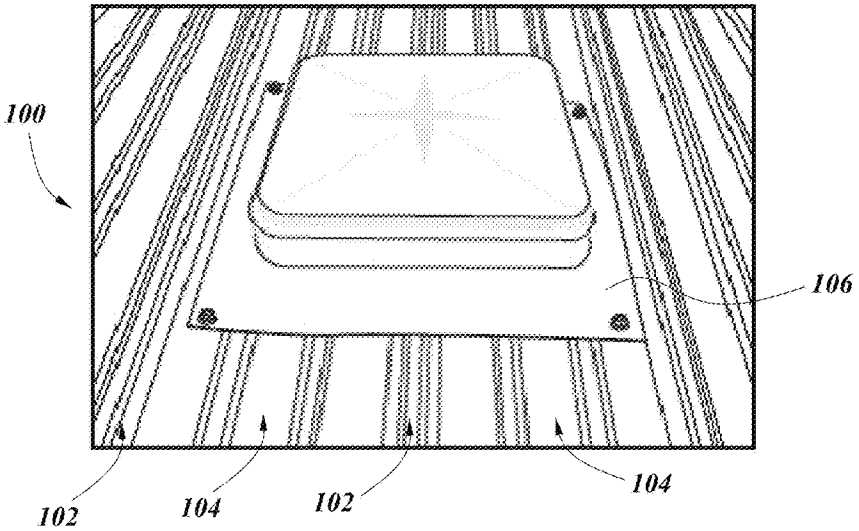

Certain embodiments of the roof vent adaptors are configured for use with corrugated roofs. Examples of a corrugated roof 100 with roof vent penetrations are shown in FIGS. 1A (rectangular roof vent) and 1B (round roof vent). As shown, the corrugated roof 100 comprises a surface with peaks 102 and valleys 104. Sealing roof penetrations in such roofs can be difficult, ineffective, and/or time consuming because a flat seal may not mate flushly with the surface of the roof, which can allow gaps to remain between portions of the roof and the seal. As described in more detail below, certain embodiments are configured to easily, effectively, and/or quickly seal roof penetrations in corrugated roofs, or other types of roofs with a generally non-planar surface.

FIGS. 2A-2H

An example of a roof vent adaptor 210 is illustrated in FIGS. 2A-2H. In various embodiments, the roof vent adaptor 210 can be configured to provide a generally water-tight seal around a penetration, such as a roof vent. Some embodiments are configured to provide such a seal on metal roofs, such as corrugated metal roofs.

As shown, the roof vent adaptor 210 can comprise a sealing member 212. The sealing member 212 can be configured to be placed on the roof surface and around the penetration. For example, the sealing member 212 can be placed over and/or around a roof vent. As shown, the sealing member 212 can have a generally flat shape. In certain configurations, the sealing member 212 is made of rubber. In some variants, the sealing member 212 is made of plastic or metal (e.g., aluminum). In some implementations, the sealing member 212 is generally uniform and/or generally continuous in a circumferential direction. For example, as shown, some embodiments do not include a radially-extending gap.

Figure 2A:
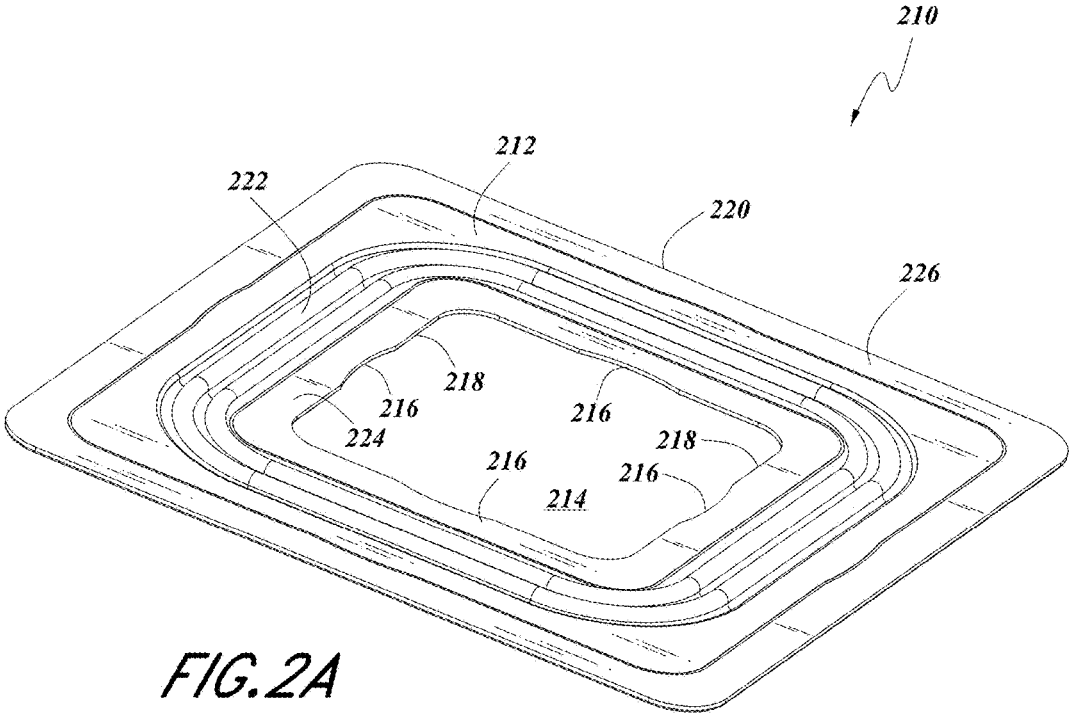
FIG. 2A illustrates a top perspective view of an embodiment of a roof vent adaptor.
Figure 2B:
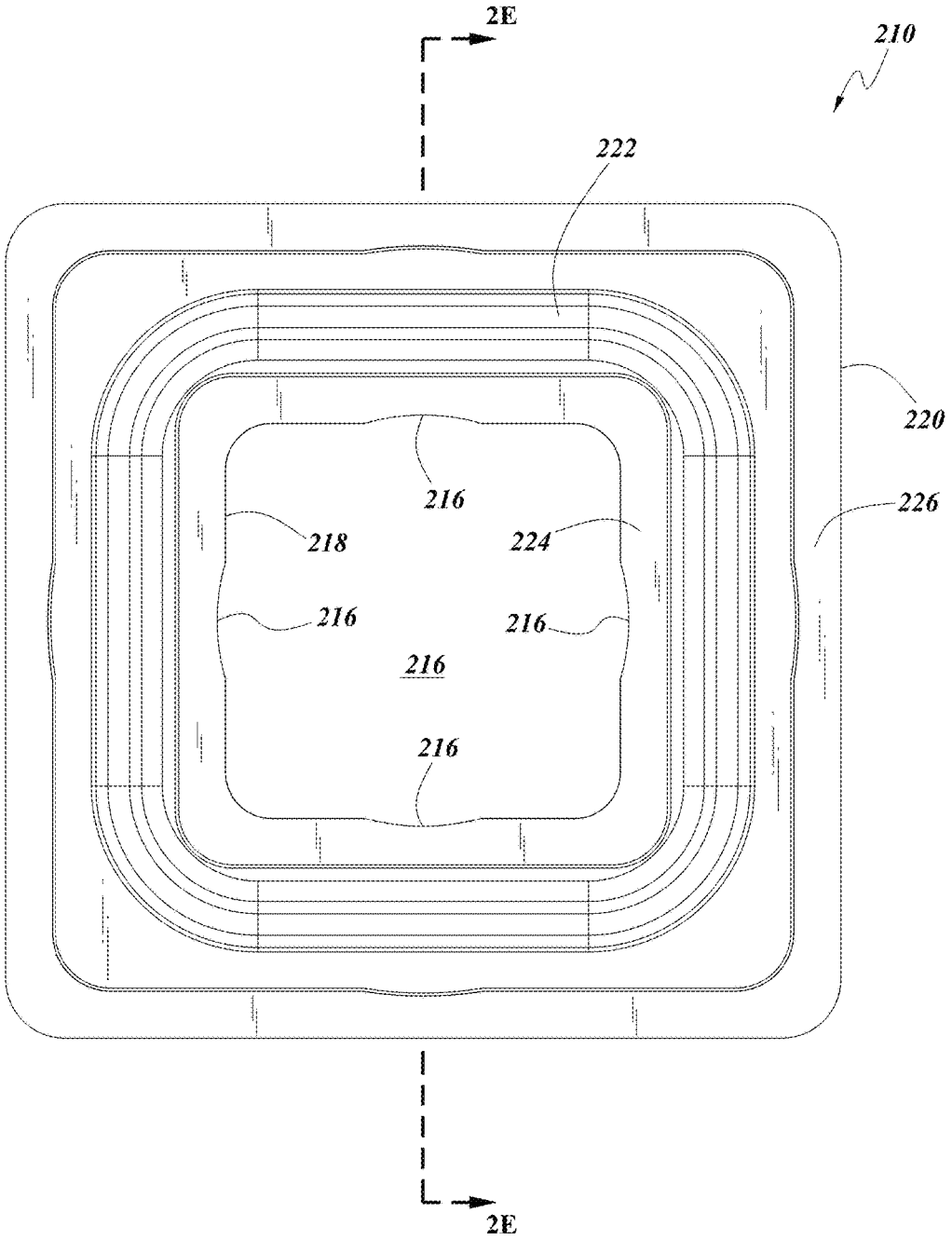
FIG. 2B illustrates a top view of the roof vent adaptor of FIG. 2A.

The sealing member 212 can have an aperture 214. The aperture 214 can be configured to receive a certain size and/or shape of vent therethrough. In some embodiments, the aperture 214 is sized and/or shaped to approximately correspond to the outside shape and/or size of the roof vent. For example, as shown, the aperture 214 can be generally rectangular and/or generally square in shape, which can correspond to a generally rectangular and/or generally square vent. In some variants, the aperture 214 is generally circular or generally elliptical in shape, which can correspond to a generally circular or generally elliptical vent. As illustrated in FIGS. 2A and 2B, some embodiments are configured for use with generally rectangular vents and with generally circular vents. For example, as shown, the aperture 214 can have a generally rectangular shape (to facilitate mating with generally rectangular vents) yet also have arcuate recesses 216 (to facilitate mating with generally circular vents). In various embodiments, the aperture 214 is configured to be slightly smaller than the size of the vent, such as the size (e.g., cross-sectional area) of the sealing member being less than or equal to 98% of the size of the vent. This can provide an interference fit between the sealing member 212 and the vent, which can promote sealing.

As illustrated, the sealing member 212 can include an inner border 218 that bounds the aperture 214. Moreover, the sealing member 212 can include an outer border 220 around the outer periphery. Typically, the length of the outer border 220 is greater than the length of the inner border 218. For example, the ratio of the length of the outer border 220 to the length of the inner border 218 can be at least about: 1.7, 1.8, 1.9, 2.0, 2.1, 2.2, ratios between the aforementioned values, or other ratios. As illustrated, in some embodiments, the shape of the inner and outer borders 218, 220 are the same, such as both being generally rectangular and/or square. In some variants, the shape of the inner and outer borders 218, 220 are different, such as the inner border 218 having a generally circular shape and the outer border 220 having a generally rectangular shape, or vice versa. In some embodiments, the inside and/or outside border 218, 220 is generally rectangular (e.g., square), circular, elliptical, triangular, pentagonal, hexagonal, octagonal, diamond-shaped, or other shapes. In certain implementations, the inside and/or outside border 218, 220 is a regular shape. In some variants, the inside and/or outside border 218, 220 is an irregular shape.

Figure 2C:
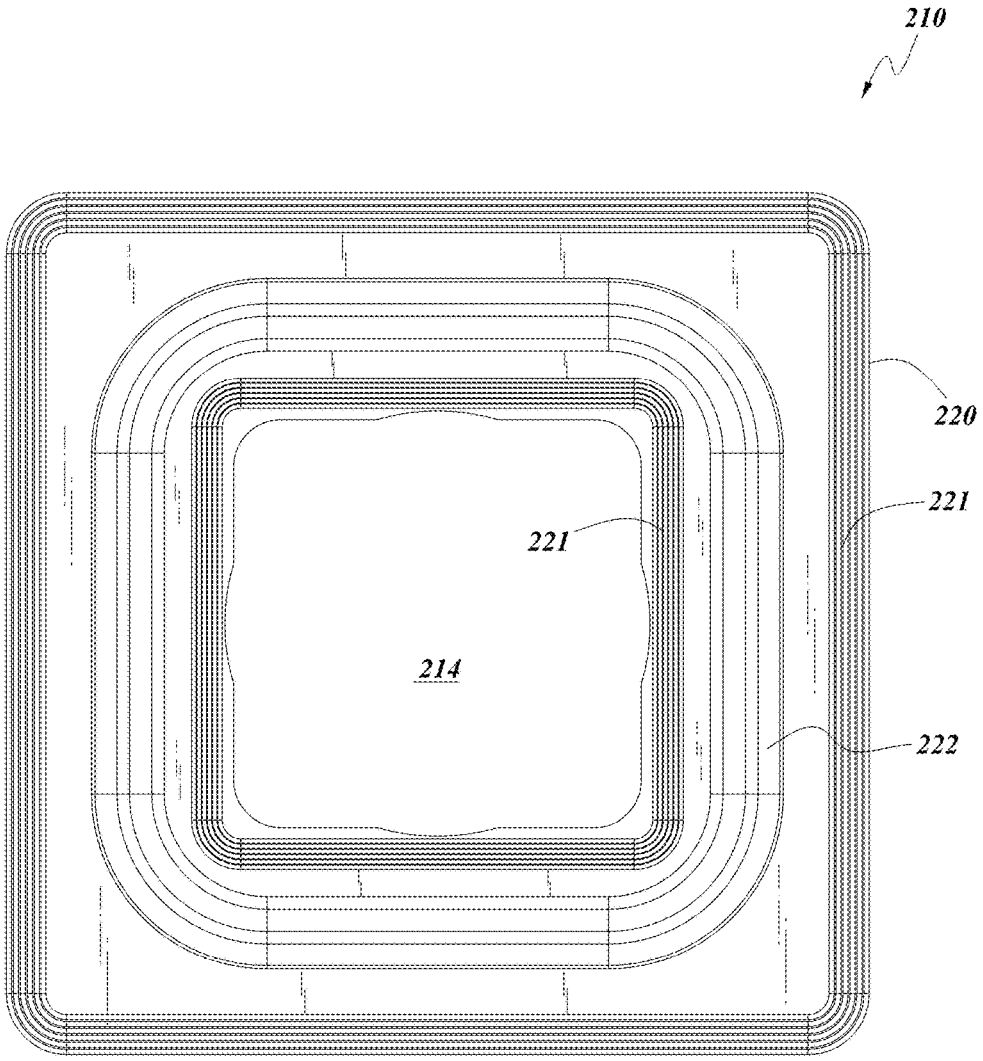
FIG. 2C illustrates a bottom view of the roof vent adaptor of FIG. 2B.

In some embodiments, the sealing member 212 includes features to aid in sealing and/or coupling with the roof surface. For example, as shown in FIG. 2C, a bottom of the sealing member 212 can include at least one deformable portion 221, such as grooves, ribs, ridges, or otherwise. In some embodiments, when the adaptor 210 is mated with the roof surface, the deformable portion 221 deforms against the roof surface, thereby providing a generally water-tight seal. As illustrated, in some embodiments the deformable portion 221 is positioned near and/or adjacent the inner border 218. In some variants, the deformable portion 221 is positioned near and/or adjacent the outer border 220. As shown, in certain implementations, the deformable portion 221 extends around substantially or completely the entire inner border 218 and/or outer border 220.

Figure 2D:
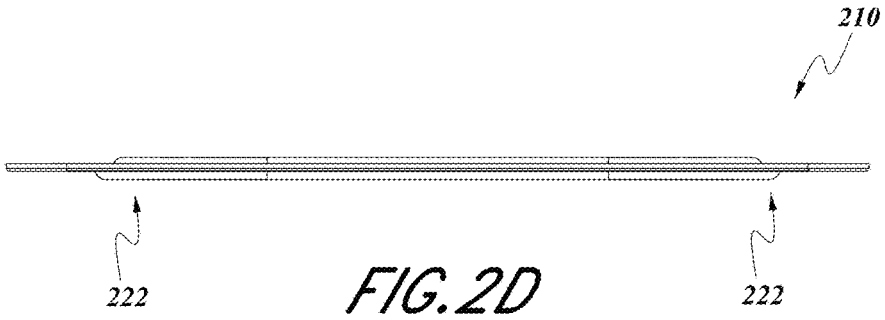
FIG. 2D illustrates a side view of the roof vent adaptor of FIG. 2A, the other side views being identical or mirror images.
Figure 2E:
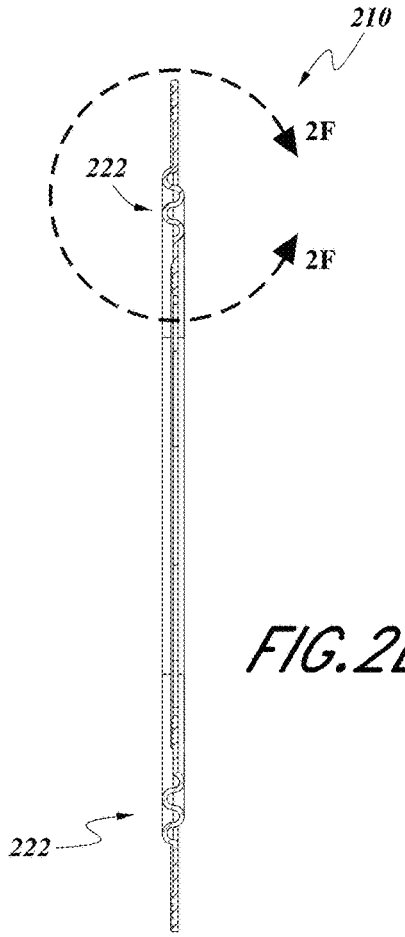
FIG. 2E illustrates a cross-sectional view of the roof vent adaptor of FIG. 2B taken along the line 2E-2E.
Figure 2F:
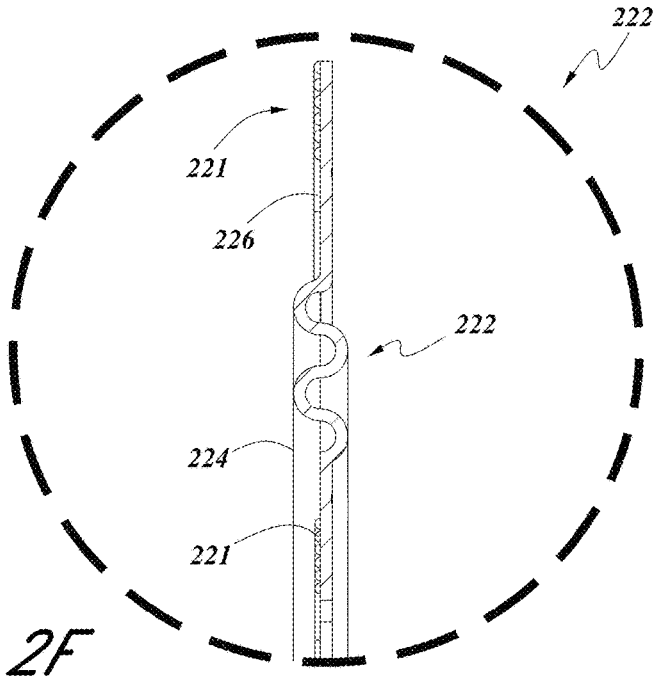
FIG. 2F illustrates a close-up view of a portion of the roof vent adaptor of FIG. 2E.

The sealing member 212 can be configured to flex. This can aid the sealing member 212 in conforming to the shape of the surface of the roof and/or the outer peripheral shape of the vent. In some embodiments, the sealing member 212 is configured to flex in the plane of the roof surface and/or perpendicular to the plane of the roof surface. In some embodiments, the sealing member 212 includes a flexible feature, such as at least one gusset 222. As shown in FIGS. 2D-2F, the gusset 222 can include at least one pleat and/or undulating feature. The gusset 222 can enable an inner portion of the sealing member 212 (e.g., a portion between the gusset 222 and the inner border 218) to move relative to an outer portion of the sealing member 212 (e.g., a portion between the gusset 222 and the outer border 220). This can facilitate, for example, installation of the adaptor 210 and/or can enable the adaptor 210 to compensate for movement of the adapter 210 and/or the roof vent, such as may occur due to thermal expansion. As illustrated, in some embodiments, the gusset 222 comprises a bellows.

The roof vent adaptor 210 can include features to aid in securing and/or sealing the roof vent adaptor 210 to the roof surface. For example, the roof vent adaptor 210 can include an inner securing band 224 and/or an outer securing band 226. The securing bands 224, 226 can comprise strips of a material that is harder than the securing member. In some embodiments, the securing bands 224, 226 comprise plastic or metal, such as aluminum. In some embodiments, the securing bands 224, 226 can be generally annular. As used herein, the term "annular" has its normal meaning, such as describing a ring-like shape. The term "annular" can include circular shapes and non-circular shapes. For example, in some embodiments, the securing bands 224, 226 comprise generally rectangular annular shapes (see FIGS. 2G and 2H). In various embodiments, as illustrated, the inner and outer securing bands 224, 226 can be positioned adjacent to the inner and outer borders 218, 220, respectively. The securing bands 224, 226 can be positioned on top of the sealing member 212. In various embodiments, as described in more detail below, the securing bands 224, 226 are configured for fasteners, such as screws, to be driven therethrough and into the roof surface. The securing bands 224, 226 can be configured to distribute a compressive force applied by the fasteners, such as across some or all of the surface area of the securing bands 224, 226, which can be greater than the surface area of the heads of the fasteners. In some embodiments, the inner and/or outer securing band 224, 226 can be generally rectangular (e.g., square), circular, elliptical, triangular, pentagonal, hexagonal, octagonal, diamond-shaped, or other shapes. In some implementations, the inner and/or outer securing band 224, 226 is a regular shape. In some variants, the inner and/or outer securing band 224, 226 is an irregular shape.

Figure 2H:
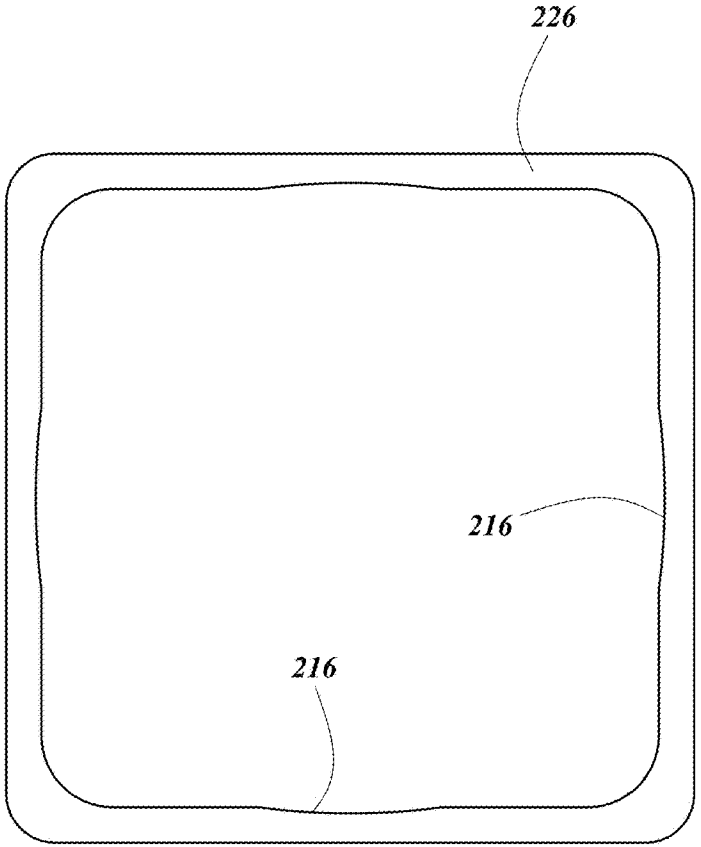
FIG. 2H illustrates a top view of an outer securing band of the roof vent adaptor of FIG. 2A.
Figure 2G:
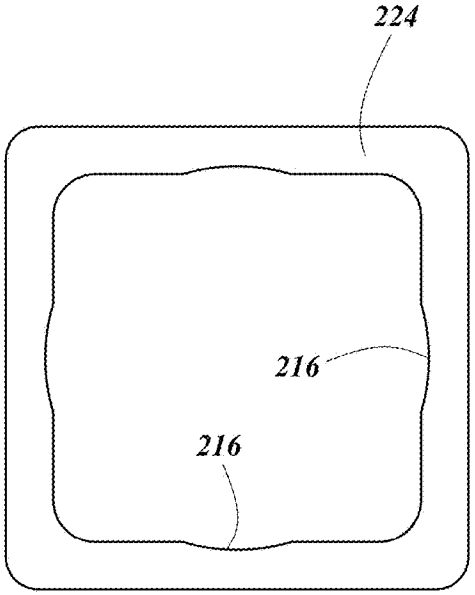
FIG. 2G illustrates a top view of an inner securing band of the roof vent adaptor of FIG. 2A.

As shown in FIGS. 2G and 2H, in some embodiments, one or both of the securing bands 224, 226 includes one or more of the recesses 216, such as arcuate recesses. In certain implementations, the radius of the recess 216 in the securing band 224 is at least about: 100 mm, 125 mm, 150 mm, 175 mm, 200 mm, radii between the aforementioned radii, or other radii. In some variants, the radius of the recess 216 in the securing band 226 is at least about: 225 mm, 250 mm, 275 mm, 300 mm, 325 mm, radii between the aforementioned radii, or other radii. In some embodiments, the recesses 216 enable the aperture 214 to be reduced in size (e.g., a smaller dimension between opposing corners), compared to not having the recesses 216. This can reduce the total length of the inner border 218 and/or can reduce the length to be sealed by the sealing member and inner securing band 224. In some embodiments, the recesses 216 enable the securing band 224 to be positioned closer to and/or flush with a portion of the outer surface of the roof vent. This can aid in supporting and/or fastening the inner securing band 224.

As also illustrated in FIGS. 2G and 2H, the securing bands 224, 226 can include safety features, such as rounded inner and/or outer corners. In some implementations, the rounded corners can reduce the chance of the corner damaging a portion of the roof vent (e.g., when the adaptor 210 is passed over the roof vent), and/or the chance of a user cutting themselves on the corner, compared to an embodiment with sharp corners. In some embodiments, the radius of curvature of one or more of the rounded corners is at least about ¼ the radius of curvature of the recess 216. In various embodiments, the rounded corners can increase the strength of the securing bands 224, 226, compared to an embodiment with sharp corners.

FIGS. 3A-3E

Another embodiment of a roof vent adaptor 310 is illustrated in FIGS. 3A-3E. The roof vent adaptor 310 can include any one, or any combination, of the features of the roof vent adaptor 210 described above. For purposes of presentation, numerals used to identify features of the roof vent adaptor 310 are incremented by a factor of one hundred in comparison to similar features of the roof vent adaptor 210. This numbering convention generally applies to the remainder of the figures. Any component or step disclosed in any embodiment in this specification can be used in other embodiments.

Figure 3A:
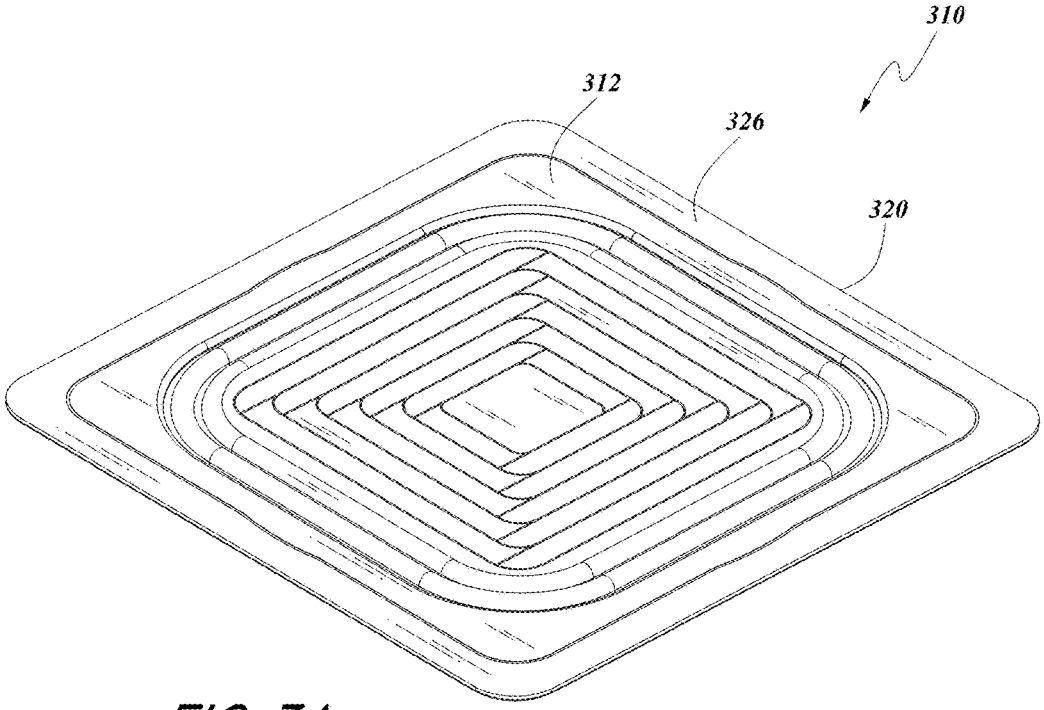
FIG. 3A illustrates a top perspective view of another embodiment of a roof vent adaptor.
Figure 3B:
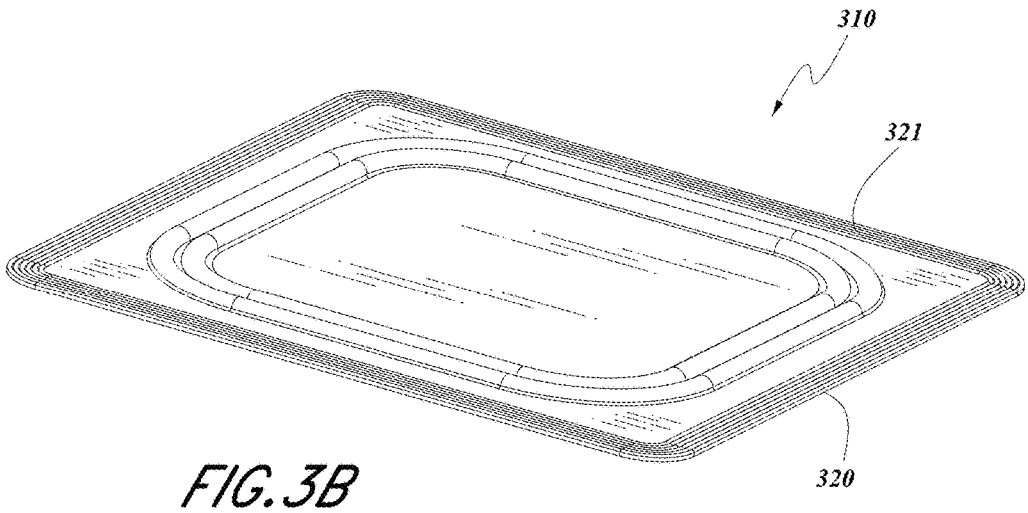
FIG. 3B illustrates a bottom perspective view of the roof vent adaptor of FIG. 3A.

As shown in FIG. 3A, the roof vent adaptor 310 can include a sealing member 312, such as a rubber sheet. In some implementations, the sealing member 312 is generally uniform and/or generally continuous in a circumferential direction. For example, the embodiment shown does not include a radially-extending gap. The roof vent adaptor 310 can include an outer securing band 326, such as an annular metal strip. The outer securing band 326 can have various shapes, such as the shapes discussed above in connection with the securing band 226. In some implementations, the roof vent adaptor 310 is provided and/or used with a strip of material that is divided into segments, called termination strips, to form an inner securing band (not shown), as is discussed in more detail below. The securing bands can be positioned on top of the sealing member 312 and can receive fasteners (e.g., screws) therethrough. As shown in FIG. 3B, the roof vent adaptor 310 can include deformable portions 321 and a gusset 322.

In some embodiments, the roof vent adaptor 310 has an aperture (not shown). The roof vent adaptor 310 can have an inner border along the aperture and an outer border 320 on an outer periphery. In certain embodiments, the length of the outer border 320 is substantially greater than the length of the inner border 318. For example, the ratio of the length of the outer border 320 to the length of the inner border can be at least about: 6.0, 6.5, 7.0, 7.5, 8.0, 8.5, 9.0, ratios between the aforementioned ratios, or other ratios. In some embodiments, the inside and/or outside border 318, 320 is generally rectangular (e.g., square), circular, elliptical, triangular, pentagonal, hexagonal, octagonal, diamond-shaped, or other shapes. In certain implementations, the inside and/or outside border 318, 320 is a regular shape. In some variants, the inside and/or outside border 318, 320 is an irregular shape.

Figure 3C:
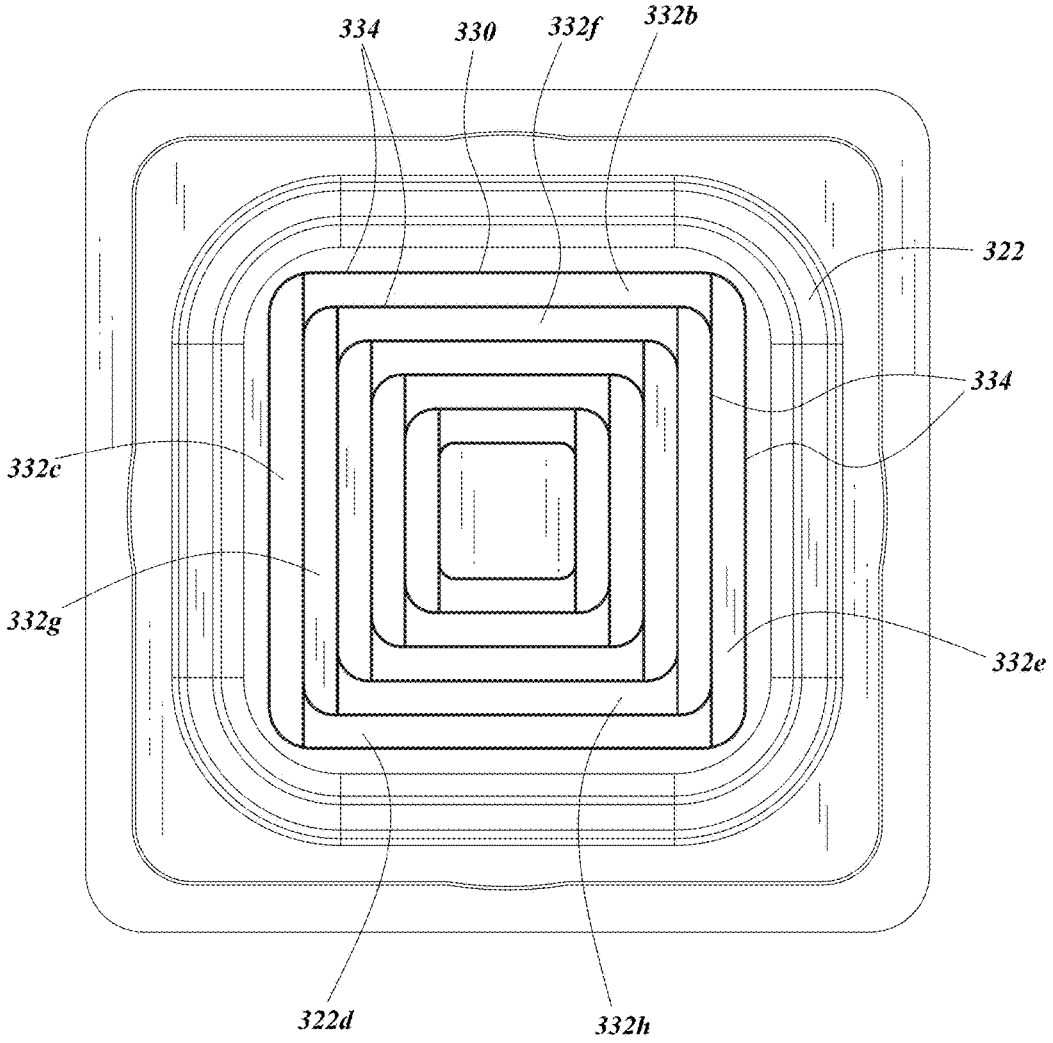
FIG. 3C illustrates a top view of the roof vent adaptor of FIG. 3A.
Figure 3D:
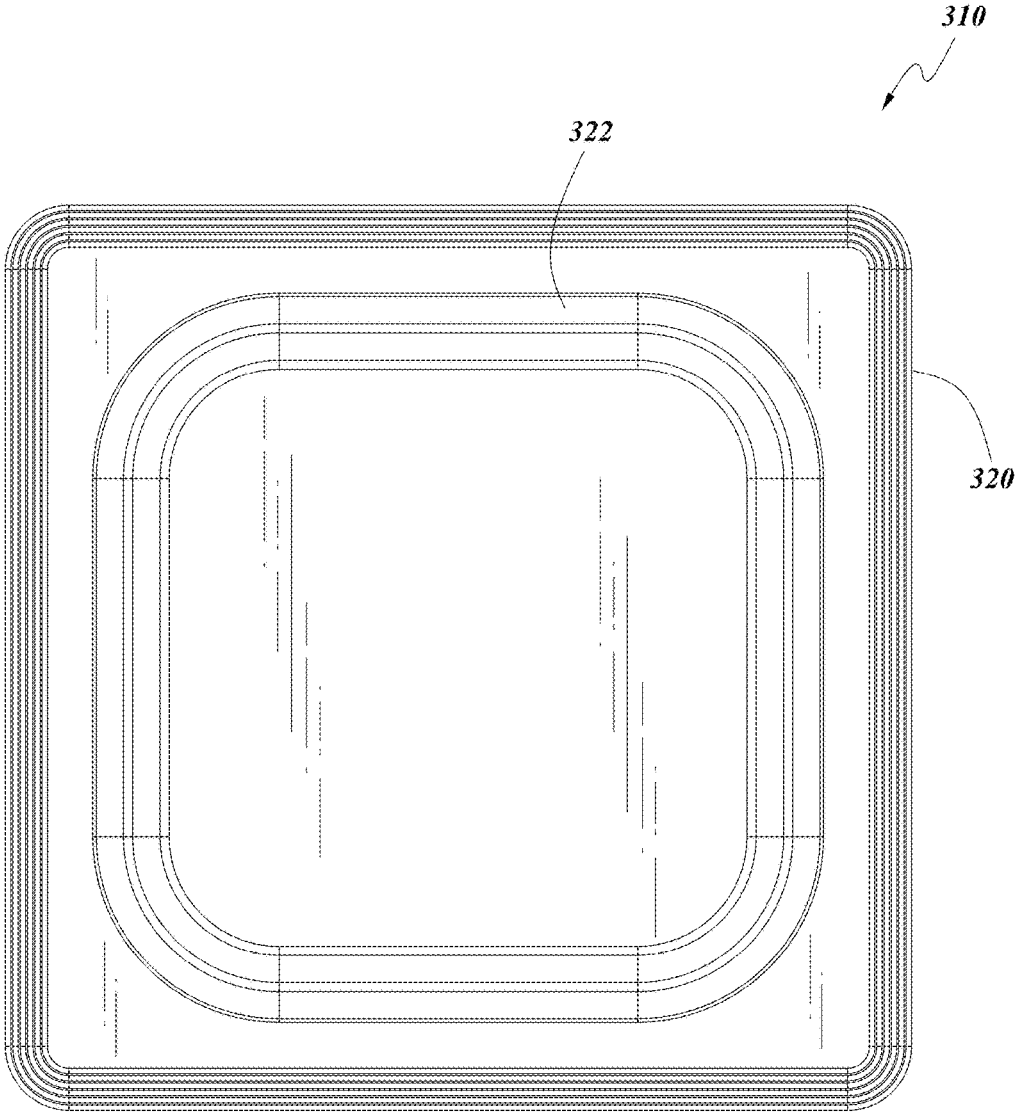
FIG. 3D illustrates a bottom view of the roof vent adaptor of FIG. 3A.
Figure 3E:
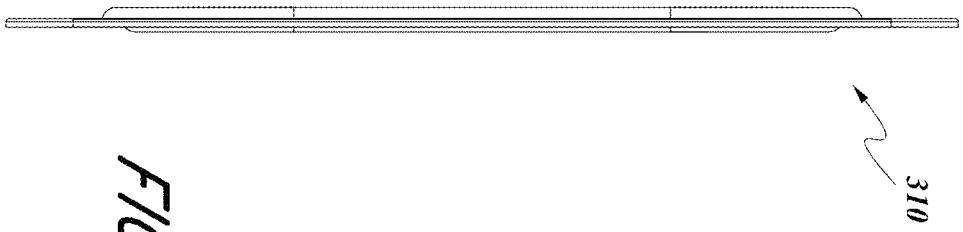
FIG. 3E illustrates a side view of the roof vent adaptor of FIG. 3A, the other side views being identical or mirror images.

Some embodiments do not include the aperture 314. As illustrated in FIGS. 3C and 3D, in some embodiments, a central portion 315 of the roof vent adaptor 310 is generally or completely continuous and/or does not include an aperture. In some embodiments, the central portion 315 is made of the same material as (e.g., rubber) and/or is unitary with the sealing member 312. In some variants, the central portion 315 is radially inward of, and/or bound by, the gusset 222. As shown, in some implementations, a bottom of the central portion 315 can be generally planar.

The roof vent adaptor 310 can be used with a variety of sizes and/or shapes of vents. In some embodiments, the sealing member 312 includes a convertible region 330. The convertible region 330 can be in the form of many different shapes and/or can be configured to be adapted to fit a wide variety of vent sizes and/or shapes. For example, in the embodiment shown, the convertible region 330 comprises a plurality of concentric generally rectangular (e.g., square) shapes. Some variants have other shapes, such as generally circular, elliptical, pentagonal, hexagonal, octagonal, diamond-shaped, or otherwise. As shown, in certain embodiments, the convertible region 330 extends radially inward, such as from a gusset 322. The convertible region 330 can include a plurality of convertible elements, such as strips 332. The strips 332 can be configured to be removed from the remainder of the sealing member 312, such as by being cut by a user. This can enable the user to adapt the convertible region 330 to the size and/or shape as needed for a particular use. In various embodiments, removal of a given strip 332 results in the strips that are radially inward of the given strip being removed also.

As an example, the embodiment shown includes a first set of strips 332A, 332B, 332C, and 332D, which are the radially outermost set of strips. To adapt the roof vent adaptor 310 to fit a roof vent having the size and/or shape of the outside periphery of the first set of strips, a user would cut or otherwise remove the strips 332A-332D, thereby adapting the size and/or shape of the aperture 314.

The embodiment shown also includes a second set of strips 332E, 332F, 332G, 332H, which are radially inward from the first set of strips. To adapt the roof vent adaptor 310 to fit a roof vent having the size and/or shape of the outside periphery of the second set of strips, a user would cut or otherwise remove the strips 332E-332H, thereby adapting the size and/or shape of the aperture 314. As shown, the various sets of strips (e.g., 332A-332D, 332E-332H, etc.) can each comprise an annular unit. In some embodiments, the annular units are concentric. For example, the second set of strips can be concentric with the first set of strips and/or other sets of strips.

As illustrated, in some embodiments, certain of the strips are longer than other of the strips. For example, the strips 332A, 332C can be longer than the strips 332B, 332D. As also shown, the ends of the shorter strips 332B, 332D can be received along the length of the longer strips 332A, 332C. The combination of longer and shorter strips 332 can enable the convertible region 330 to be readily converted to at least two different shapes. For example, some embodiments are configured such that removal of certain set of the strips 332 provides an aperture 314 of a first shape and removal of a different set of the strips 332 provides an aperture 314 of a second shape. In the embodiment shown, removal of the strips 332B and 332D would result in an aperture 314 with a generally rectangular shape, and removal of the strips 332A-332D would result in an aperture 314 with a generally square shape. As shown, certain strips can be generally perpendicular to other of the strips. For example, the strips 332A, 332C can be generally perpendicular to the strips 332B, 332D. In various embodiments, the adaptor is configured for use with at least two different roof vent shapes and/or sizes.

The sealing member 312 can include removal features 334. The removal features 334 can be configured to aid in removing a desired one or group of the strips 332 from the remainder of the sealing member 312. In some embodiments, the removal features 334 comprise scores, grooves, weakened areas, or the like. As shown, the removal features 334 can bound (e.g., surround) the strips, such as individually. Some embodiments include indicia, such as indications of size and/or shape. The indicia can be integral with (e.g., molded as a part of) or painted on the sealing member 312. This can aid a user in readily identifying which strips to remove to achieve a certain size and/or shape for the aperture 314.

FIGS. 4A-4K

Another embodiment of a roof vent adaptor 410 is shown in FIGS. 4A-4K. In certain implementations, the roof vent adaptor 410 is configured for use with a variety of sizes and/or shapes of the vent. The roof vent adaptor 410 can include any one, or any combination, of the features of the roof vent adaptors 210, 310 described above. For example, the roof vent adaptor 410 can have an outer border with any of the shapes of the outer borders 220, 320. Any component or step disclosed in any embodiment in this specification can be used in other embodiments.

As shown, the roof vent adaptor 410 can include a sealing member 412, such as a rubber sheet. The roof vent adaptor 410 can include an outer securing band 426, such as an annular metal strip. The outer securing band 326 can have various shapes, such as the shapes discussed above in connection with the securing band 226. In some implementations, the roof vent adaptor 410 is provided and/or used with a strip of material that is divided into segments, called termination strips, to form an inner securing band (not shown), as is discussed in more detail below. The securing bands can be positioned on top of the sealing member 412 and can receive fasteners (e.g., screws) therethrough.

Figure 4A:
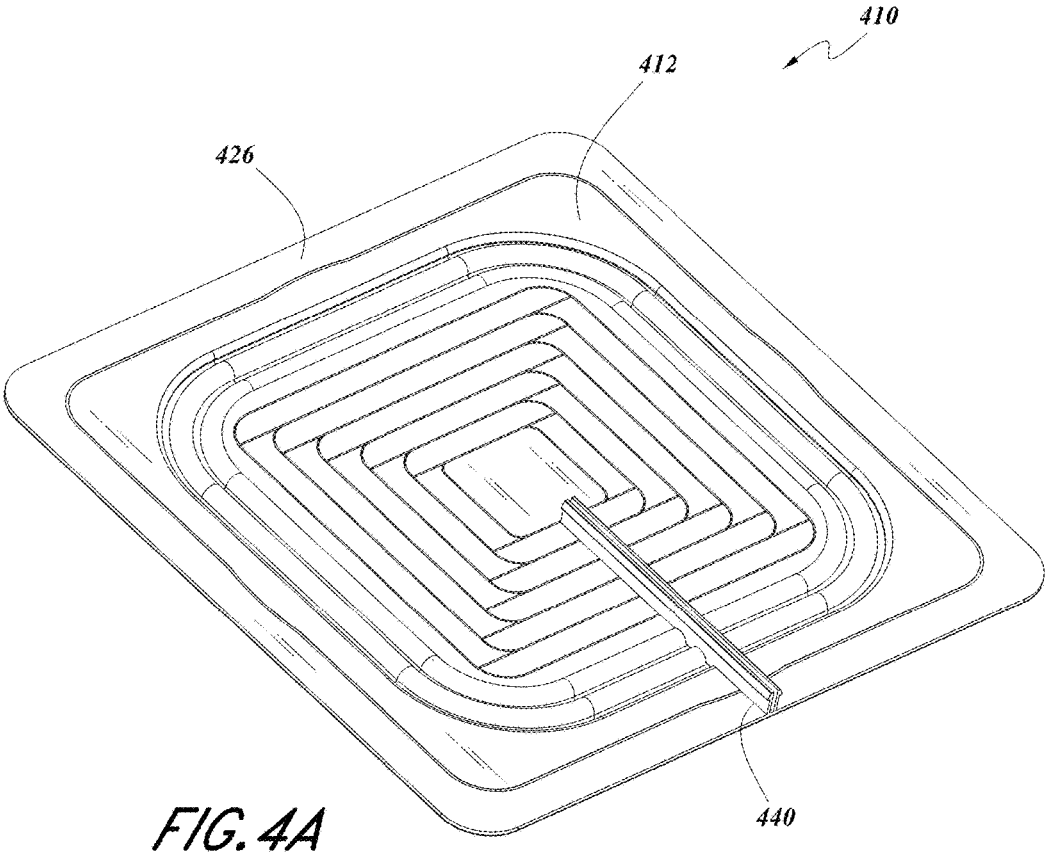
FIGS. 4A and 4B illustrate top perspective views of another embodiment of a roof vent adaptor.
Figure 4B:
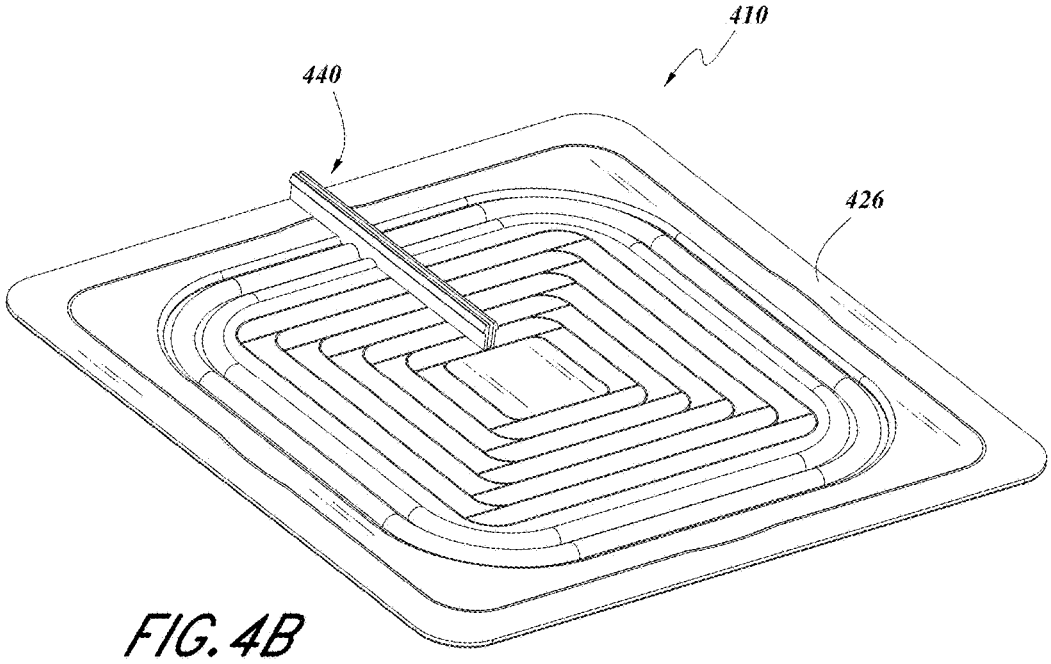
Figure 4C:
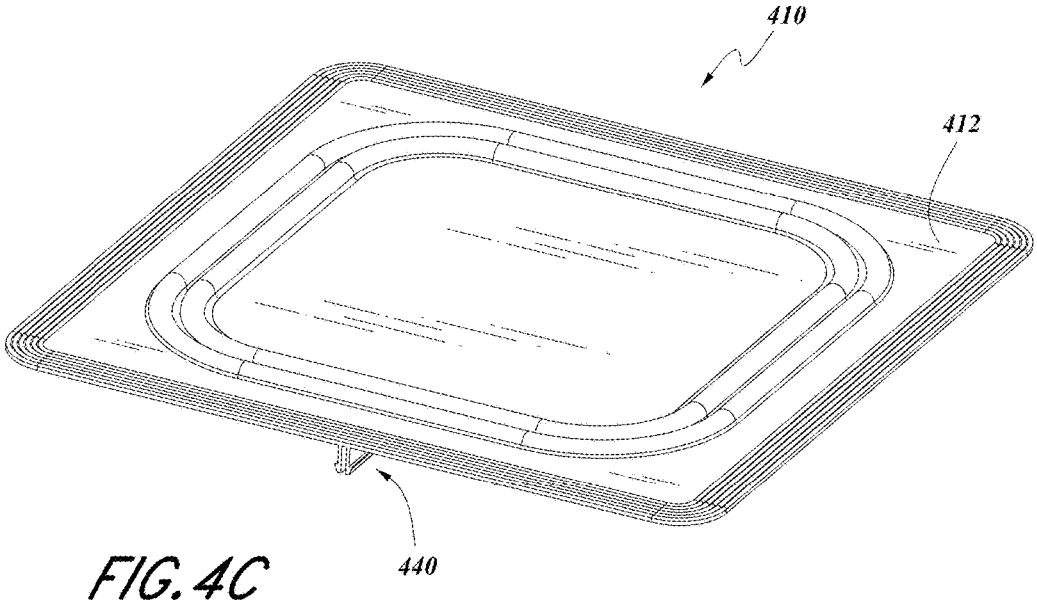
FIG. 4C illustrates a bottom perspective view of the roof vent adaptor of FIG. 4A.
Figure 4D:
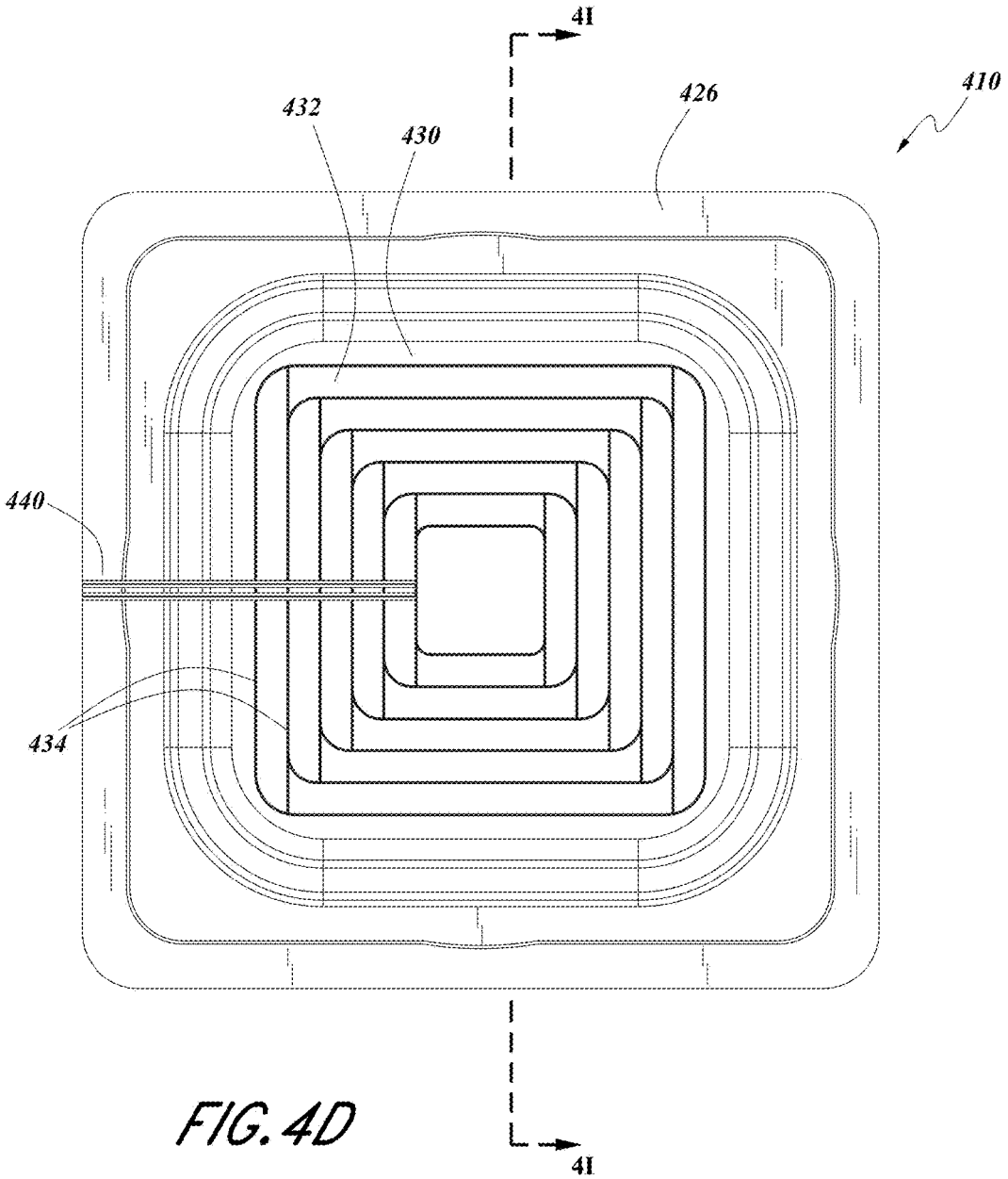
FIG. 4D illustrates a top view of the roof vent adaptor of FIG. 4A.
Figure 4E:
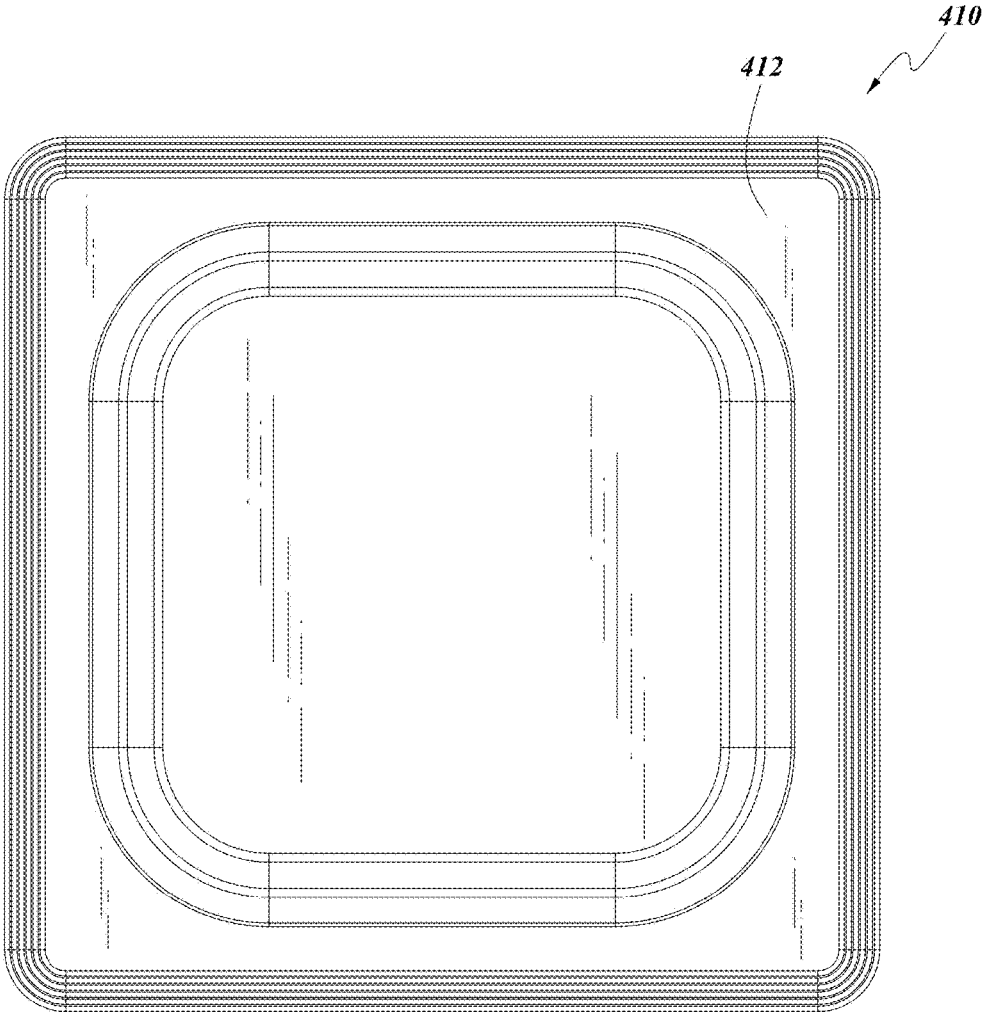
FIG. 4E illustrates a bottom view of the roof vent adaptor of FIG. 4A.
Figure 4F:
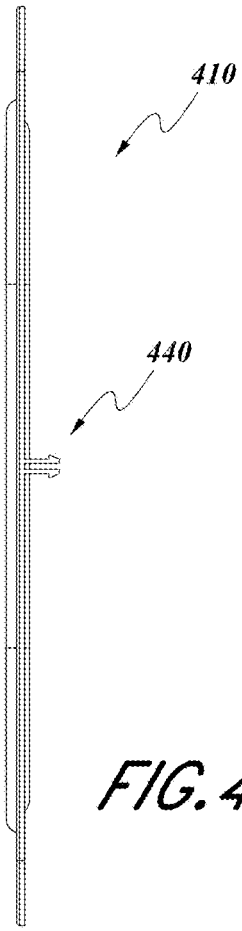
FIG. 4F illustrates a left side view of the roof vent adaptor of FIG. 4A.
Figure 4G:
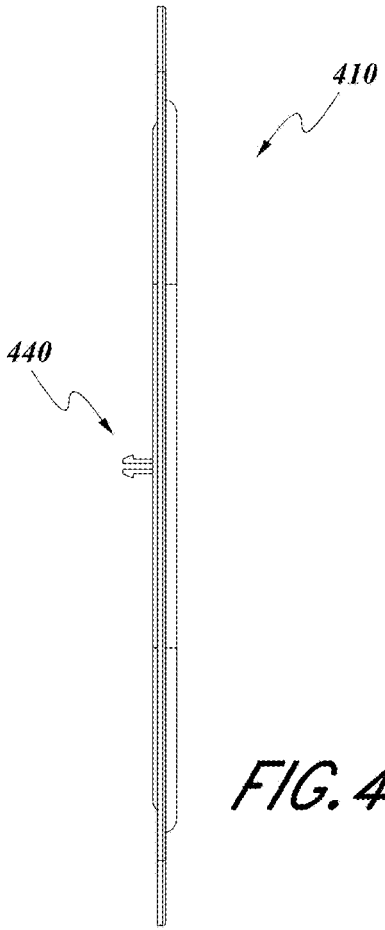
FIG. 4G illustrates a right side view of the roof vent adaptor of FIG. 4A.
Figure 4H:
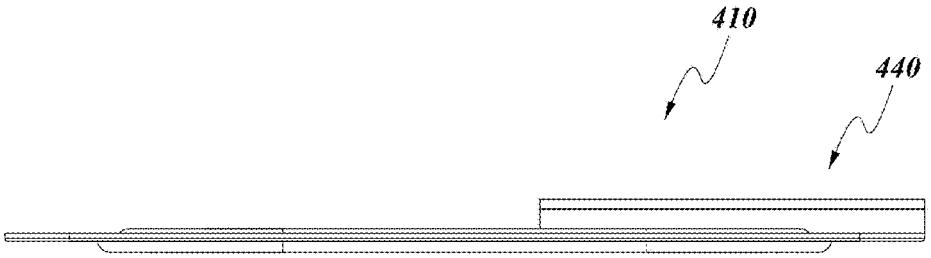
FIG. 4H illustrates a front view of the roof vent adaptor of FIG. 4A, the rear view being a mirror image.
Figure 4I:
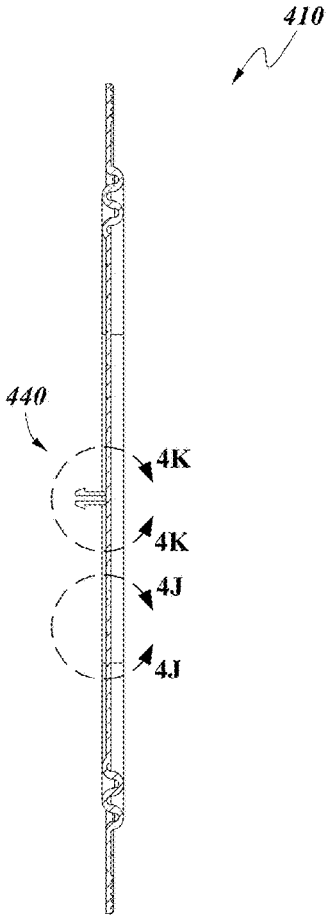
FIG. 4I illustrates a cross-sectional view of the roof vent adaptor of FIG. 4D.
Figure 4J:
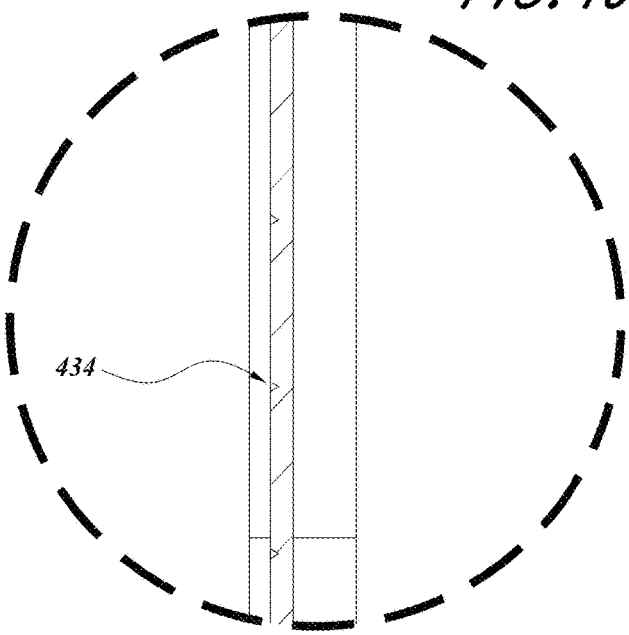
FIGS. 4J and 4K illustrate close-up views of portions of the roof vent adaptor of FIG. 4I.

As illustrated, the roof vent adaptor 410 can include a convertible region 430, which can be similar or identical to the convertible region 330. For example, the convertible region 430 can include strips 432 or other portions that are configured to be removed to enable a user to adapt the roof vent adaptor 410 to correspond with a plurality of vent shapes and/or sizes. The sealing member 412 can include removal features 434 to aid in removing a desired one or group of the strips 432 from the remainder of the sealing member 412. For example, as shown in FIG. 4D, the sealing member 412 can be bounded by scores, grooves, weakened areas, or the like. As illustrated, in some embodiments, one or more of the removal features 434 comprise a generally V-shaped groove.

In some implementations, the roof vent adaptor 410 is generally non-uniform and/or generally discontinuous in a circumferential direction. For example, the roof vent adaptor 410 can have an expanding feature, such as a radially-extending channel 440. In some embodiments, the channel 440 is initially closed, such as the sealing member 412 extending through the channel 440. The channel 440 can be configured to open. For example, the channel 440 can comprise a discontinuity (e.g., a slit, split, gap, seam, perforations, etc.) that facilitate opening the channel 440. Opening the channel 440 can enable the roof vent adaptor 410 to be expanded circumferentially. This can allow the roof vent adaptor 410 to be wrapped around a roof vent. For example, the roof vent adaptor 410 can be configured to be mated with the roof vent radially and/or in a direction generally parallel to the roof surface. This can be helpful in applications where the roof vent is already installed, such as when retrofitting an existing roof vent.

Figure 4K:
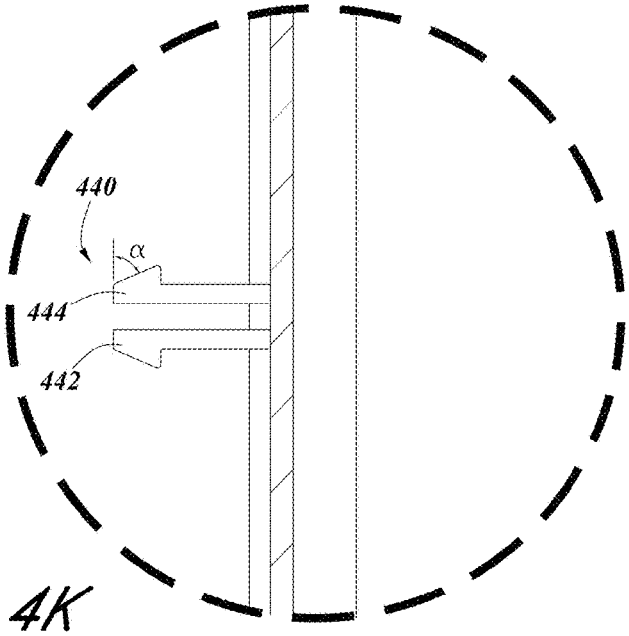

As shown in the cross-sectional view of FIG. 4K, in some embodiments, the channel 440 includes a first leg 442 and a second leg 444. The legs 442, 444 can extend upwardly from the top surface of the sealing member 412. The legs 442, 444 can have cammed surfaces that are at a non-zero acute angle α, which can be less than or equal to about 75°. In some embodiments, the sealing member 412 extends between the legs 442, 444. In some embodiments, a user can open the channel 440 by cutting between or otherwise separating the legs 442, 444. In some embodiments, the channel 440 is opened by a user activating frangible portions (e.g., perforations) between the legs 442, 444.

As discussed in more detail below, the channel 440 can be configured to engage with a closure unit (see FIGS. 6C and 6D). For example, the closure unit can be configured to slide along the channel 440 in the radial direction and/or to compress the legs 442, 444 toward each other in the circumferential direction. The closure unit can thus secure the channel 440 and/or inhibit the roof vent adaptor 410 from expanding circumferentially. The closure unit can comprise an elongate member with a plurality of deformable segments. In some embodiments, the deformable segments are configured to be compressed by a crimping tool, such as pliers. In certain variants, the closure unit is metal, such as aluminum.

FIGS. 5A-5I

A method of using a roof vent adaptor is illustrated in FIGS. 5A-5I. In some embodiments, the method of FIGS. 5A-5I is applicable for applications where the roof vent is being newly installed, such as in new construction, and/or where the roof vent comprises a radially outwardly extending flashing 106. The method could be used in conjunction with the roof vent shown in FIG. 1A.

In some embodiments, the method includes obtaining a roof vent adaptor, such as the adaptor 210 described above. The method can include selecting the roof vent adaptor having an aperture that substantially corresponds to the size and/or shape of the roof vent. In some embodiments, the roof vent adaptor includes a sealing member and inner and outer securing bands.

In some embodiments, the method includes placing the roof vent adaptor over the roof vent so that the vent extends through the aperture. For example, the roof vent adaptor can be placed over the top of the vent and moved downward, such as toward the roof surface and/or in a direction generally perpendicular to the roof surface.

Figure 5A:
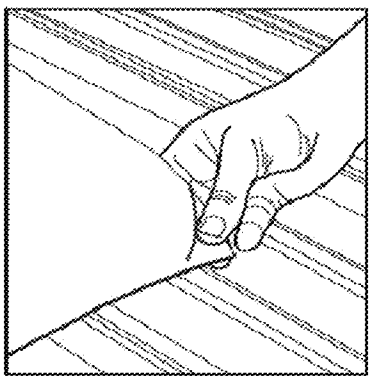
FIGS. 5A-5I illustrate an example installation process of a roof vent adaptor, such as on the roof vent of FIG. 1A.
Figure 5B:
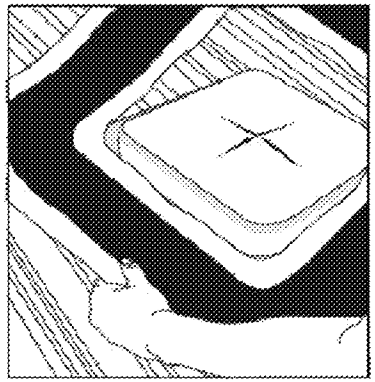
Figure 5C:
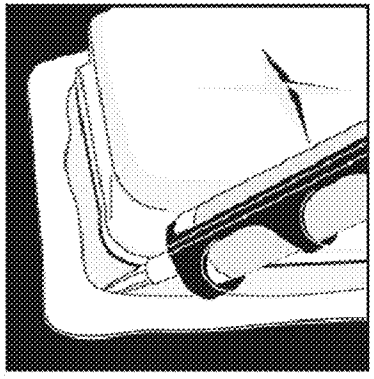

As shown in FIG. 5A, the method can include block 550, which includes deforming (e.g., bending down) corners of the roof vent and/or the roof vent adaptor to reduce the chance of sharp corners protruding from the installed device. As illustrated in FIG. 5B, the method can include block 551, which includes sliding the roof vent adaptor over the roof vent. As shown in FIG. 5C, the method can include block 552, which includes applying sealant (e.g., caulk) under the inner securing band, such as between the sealing member and the roof surface.

Figure 5D:
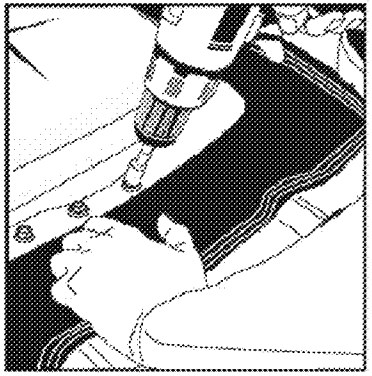

As shown in FIG. 5D, the method can include block 553, which includes securing the inner securing band. For example, the method can include driving fasteners (e.g., screws, bolts, rivets, etc.) through the inner securing band and the sealing member and into the roof. The method can include tightening the fasteners, thereby compressing the sealing member against the roof surface. In various embodiments, the securing bands can distribute the pressure of the fasteners, which can reduce localized areas of high compression force, increase the seal between the sealing member and the roof surface, and/or reduce the chance of the fasteners ripping or otherwise damaging the sealing member.

Figure 5F:
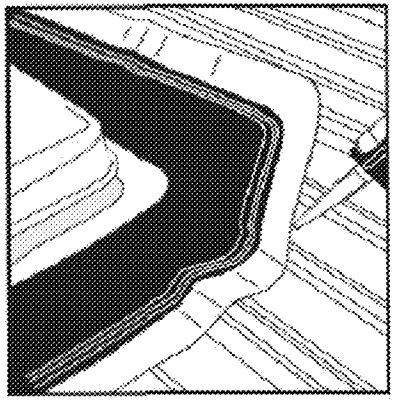
Figure 5E:
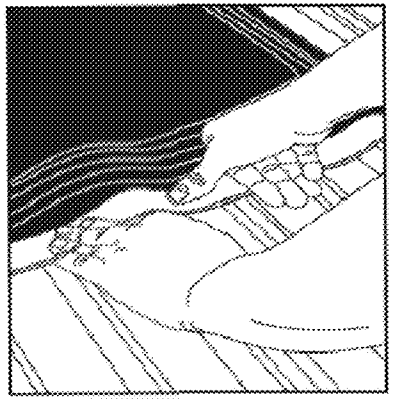

As illustrated in FIG. 5E, the method can include block 554, which includes deforming the roof vent adaptor to substantially conform to the profile of the roof. In several embodiments, the roof vent adaptor is readily deformable by a person. The method can include block 555, which includes applying sealant (e.g., caulk) under the outer securing band, such as between the sealing member and the roof surface, as shown in FIG. 5F.

Figure 5H:
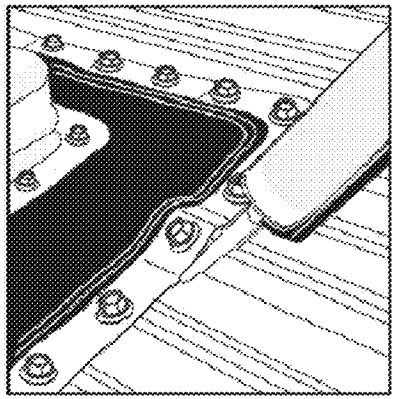
Figure 5G:
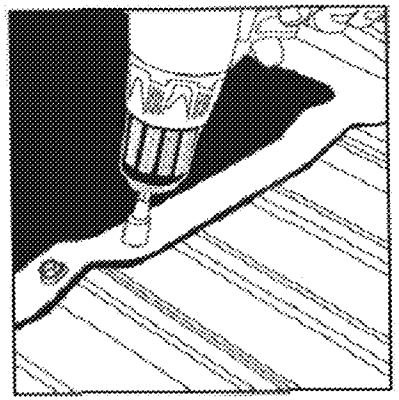

In some embodiments, as illustrated in FIG. 5G, the method includes block 556, which includes securing the outer securing band. For example, the method can include driving fasteners 108 (e.g., screws, bolts, rivets, etc.) through the outer securing band and the sealing member and into the roof. The method can include tightening the fasteners 108, thereby compressing the sealing member against the roof surface. In some embodiments, the method includes positioning the fasteners 108 around substantially the entire outer periphery of the sealing member and/or periphery of the aperture. In certain variants, the fasteners 108 can be spaced less than 1.5 inches apart and/or generally consistently spaced. As shown in FIG. 5H, the method can include block 557, which includes applying sealant to any open gaps between the roof vent adaptor and the roof surface. In some implementations, the method includes applying additional sealant, such as after the fasteners 108 have been installed. For example, in some instances in which the roof vent adaptor is used with a roof vent that does not include a flashing 106, the method includes applying additional sealant.

Figure 5I:
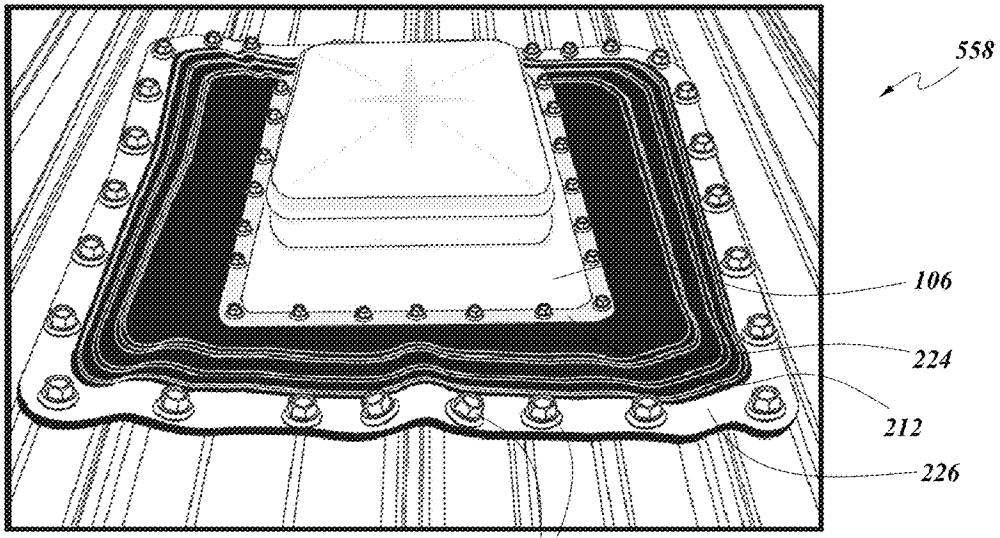

As illustrated in FIG. 5I, the method can include block 558, which includes providing a roof vent adaptor that substantially conforms to the shape of the roof surface and/or that provides a generally liquid-tight seal around the roof vent to inhibit or prevent water intrusion into the building.

FIGS. 6A-6M

Another method of using a roof vent adaptor is illustrated in FIGS. 6A-6M. In some embodiments, the method of FIGS. 6A-6M is applicable for applications where the roof vent is already present, such as when retrofitting an existing roof vent. The method could be used in conjunction with the roof vent shown in FIG. 1B.

In some embodiments, the method includes obtaining a roof vent adaptor, such as the adaptor 310 or the adaptor 410 described above. The roof vent adaptor can include a convertible region. As shown in FIG. 6A, the method can include block 660, which includes deforming (e.g., bending down) corners of the roof vent and/or the roof vent adaptor to reduce the chance of sharp corners protruding from the installed device.

Figure 6B:
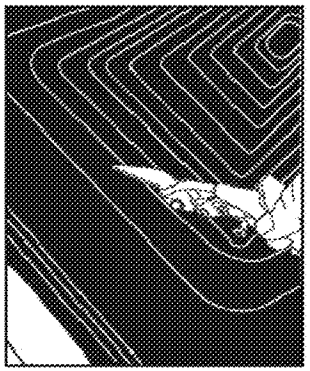
FIGS. 6A-6M illustrate another example installation process of a roof vent adaptor, such as on the roof vent of FIG. 1B.
Figure 6A:
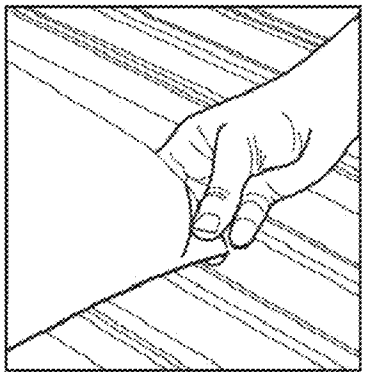

As illustrated in FIG. 6B, the method can include block 661, which includes producing an aperture that substantially corresponds to the size and/or shape of the roof vent. For example, the method can include selecting and removing portions of the convertible region to produce the aperture. In some embodiments, the method includes cutting (e.g., with shears) along grooves or indicia to remove the desired portions. The method can include cutting or otherwise separating strips of the convertible region from the remainder of the sealing member. In some embodiments, the method includes forming a generally square or rectangular aperture in the convertible region of the sealing member. In some embodiments, the method includes cutting along a channel of the sealing member, such as between a first leg and a second leg. In certain implementations, the method includes producing a radially-extending gap in the sealing member.

The method can include engaging the roof vent adaptor with the roof vent so that the vent extends through the aperture. In some embodiments, the method includes expanding the roof vent adaptor circumferentially. For example, the method can include opening the channel of the roof vent adaptor, such as by increasing the circumferential distance between the first and second legs. The method can include moving the expanded roof vent adaptor into engagement with the roof vent. For example, the roof vent adaptor can be moved radially and/or in a direction generally parallel to the roof surface. The method can include wrapping the roof vent adaptor around the roof vent. In certain variants, the method includes placing the roof vent adaptor over the roof vent and moved downward, such as toward the roof surface and/or in a direction generally perpendicular to the roof surface.

Figure 6C:
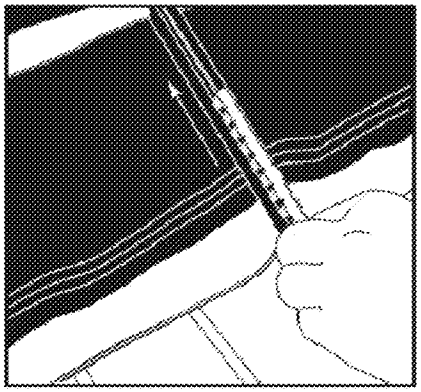

As illustrated in FIG. 6C, the method can include block 662, which includes engaging a closure unit with the channel. For example, as shown, the method can include sliding the closure unit along the channel in the radial direction, such as along the first leg and the second leg. In some embodiments, the closure unit is slid radially inwardly.

Figure 6D:
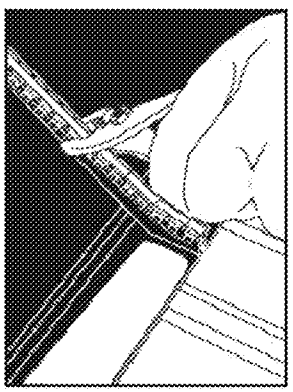

As shown in FIG. 6D, the method can include block 663, which includes securing the closure unit to the channel. For example, the method can include deforming (e.g., crimping) deformable segments of the closure unit against the first and second legs of the channel. In some embodiments, the closure unit presses and/or secures the first and second legs of the channel together. In certain variants, the closure unit inhibits or prevents the first and second legs from separating, and thus inhibits or prevents the sealing member from expanding circumferentially. In some implementations, the crimping is performed with a tool, such as pliers.

Figure 6E:
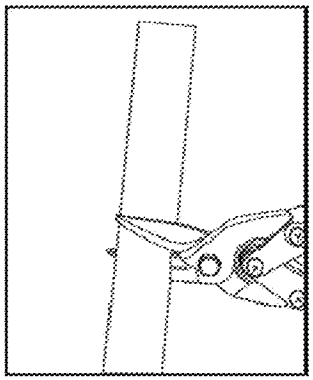
Figure 6F:
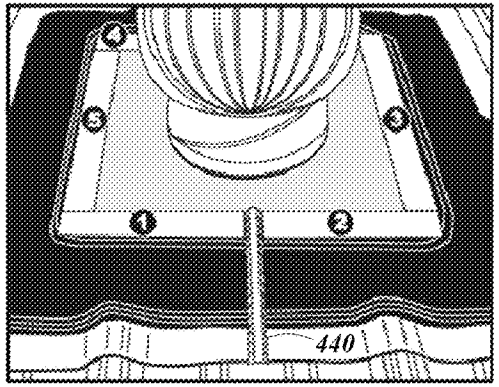

In some embodiments, the method includes forming an inner securing band. For example, as shown in FIG. 6E, the method can include block 664, which includes obtaining a portion of material from which to form one or more segments, called termination strips. In some embodiments, the termination strips are aluminum. The method can include cutting (e.g., with shears) the portion of material to form the termination strips. As shown in FIG. 6F, the method can include block 665, which includes arranging the termination strips to form the inner securing band. In some embodiments, as illustrated, the inner securing band is substantially continuous around the inner border of the sealing member. In some variants, the inner securing band has a gap located at the channel.

Figure 6H:
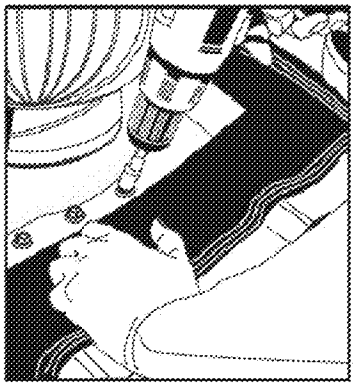
Figure 6J:
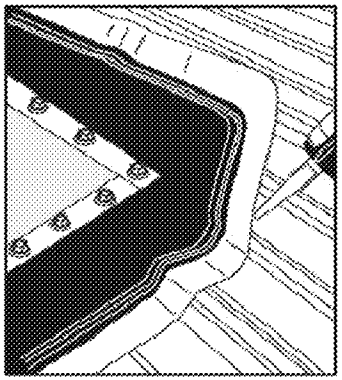
Figure 6G:
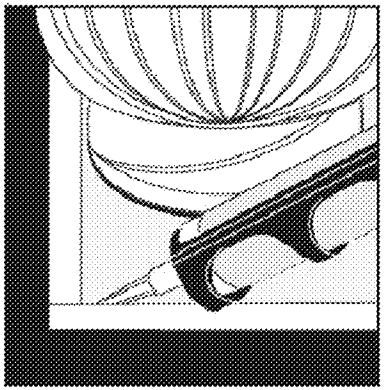

As shown in FIG. 6G, the method can include block 666, which includes applying sealant (e.g., caulk) under the inner securing band. For example, sealant can be applied between the sealing member and the roof surface.

As shown in FIG. 6H, the method can include block 667, which includes securing the inner securing band. For example, the method can include driving fasteners (e.g., screws, bolts, rivets, etc.) through the inner securing band and the sealing member and into the roof. The method can include tightening the fasteners, thereby compressing the sealing member against the roof surface. In various embodiments, the securing bands can distribute the pressure of the fasteners.

Figure 6I:
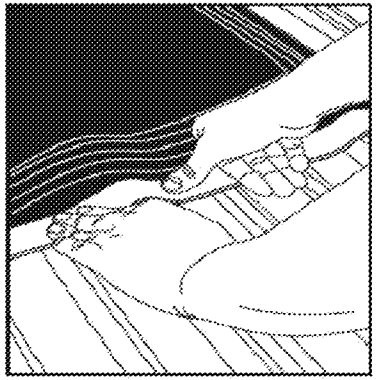

As illustrated in FIG. 6I, the method can include block 668, which includes deforming the roof vent adaptor to substantially conform to the profile of the roof. In several embodiments, the roof vent adaptor is readily deformable by a person. The method can include block 669, which includes applying sealant (e.g., caulk) under the outer securing band, such as between the sealing member and the roof surface, as shown in FIG. 6J.

Figure 6L:
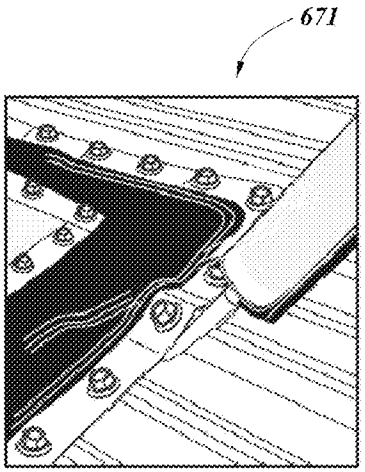
Figure 6K:
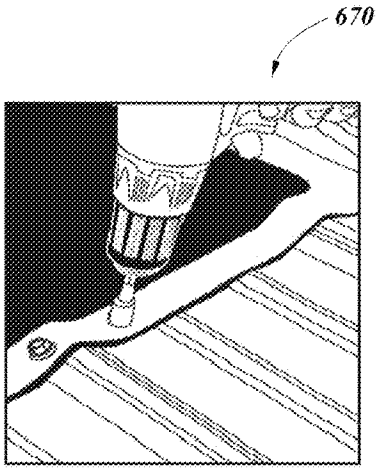

In some embodiments, as illustrated in FIG. 6K, the method includes block 670, which includes securing the outer securing band. For example, the method can include driving fasteners 108 (e.g., screws, bolts, rivets, etc.) through the outer securing band and the sealing member and into the roof. The method can include tightening the fasteners 108, thereby compressing the sealing member against the roof surface. In some embodiments, the method includes positioning the fasteners 108 around substantially the entire outer periphery of the sealing member and/or periphery of the aperture. In certain variants, the fasteners 108 can be spaced less than 1.5 inches apart and/or generally consistently spaced. As shown in FIG. 6L, the method can include block 670, which includes applying sealant to any open gaps between the roof vent adaptor and the roof surface. In certain embodiments, the method includes applying additional sealant, such as after the fasteners 108 have been installed. For example, in some instances in which the roof vent adaptor is used with a roof vent that does not include a flashing 106, the method includes applying additional sealant.

Figure 6M:
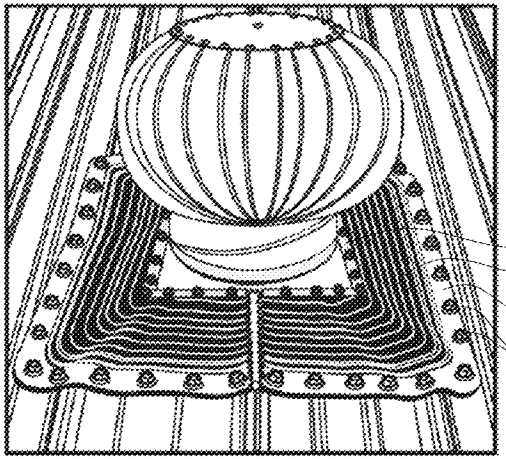

As illustrated in FIG. 6M, the method can include block 672, which includes providing a roof vent adaptor that substantially conforms to the shape of the roof surface and/or that provides a generally liquid-tight seal around the roof vent to inhibit or prevent water intrusion into the building.

Figure 7:
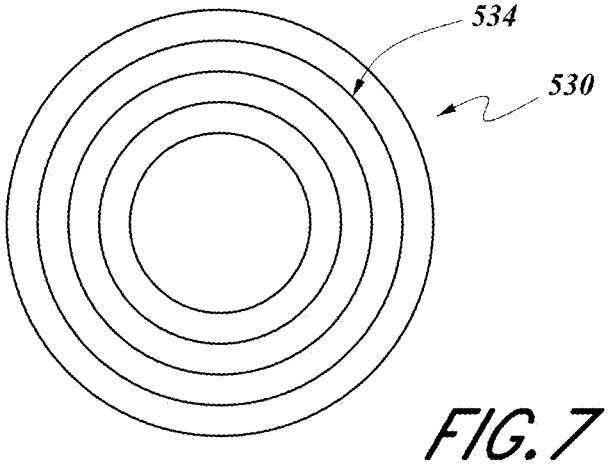
FIG. 7 illustrates a top view of an embodiment of a convertible region having a circular shape.
Figure 8:
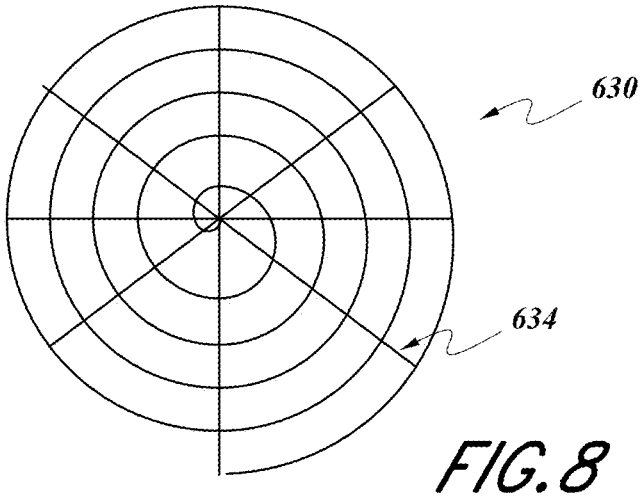
FIG. 8 illustrates a top view of an embodiment of a convertible region having a spiral shape.

FIGS. 7 and 8

As previously mentioned, the convertible regions described herein can be in the form of many different shapes and/or can be configured to be adapted to fit a wide variety of vents. For example, in certain embodiments a convertible region 530 comprises a plurality of generally rectangular (e.g., square) concentric shapes. Some variants have other shapes, such as the generally circular concentric shapes shown in FIG. 7. As shown, the convertible region 530 can include removal features 534 that are configured to aid in removing a desired portion of the convertible portion 530 from the adaptor. In some embodiments, the removal features 534 comprise scores, grooves, weakened areas, or the like.

In certain implementations, the convertible region comprises a non-concentric series of shapes and/or irregular shapes. For example, as shown in FIG. 8, in some embodiments, the adaptor has a convertible region 630 with a spiral shape. The convertible region 630 can include removal features 634 that are configured to aid in removing a desired portion of the convertible portion 630 from the adaptor. In some embodiments, the removal features 634 comprise scores, grooves, weakened areas, or the like. In certain variants, the removal features 634 can extend along the spiral. As shown, in some embodiments, the removal features 634 can extend radially. Certain embodiments include indicia, such as indications of size and/or shape. The indicia can be adjacent to one or more of the removal features 630.

The indicia can aid a user in readily identifying which portions of the convertible portion 630 to remove to achieve a certain size and/or shape.

Certain Terminology

Terms of orientation used herein, such as "top," "bottom," "horizontal," "vertical," "longitudinal," "lateral," and "end" are used in the context of the illustrated embodiments. However, this disclosure should not be limited to the illustrated orientation. Other orientations are possible and are within the scope of this disclosure.

Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. For example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a device configured to carry out recitations A, B, and C" can include a first device configured to carry out recitation A working in conjunction with a second device configured to carry out recitations B and C.

The terms "comprising," "including," "having," and the like are synonymous and are used inclusively, in an open-ended fashion, and do not exclude additional elements, features, acts, operations, and so forth Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

Various roof vent adaptors have been disclosed. Although the roof vent adaptors have been disclosed in the context of certain embodiments and examples, the scope of this disclosure extends beyond the specifically disclosed embodiments to other alternative embodiments and/or uses of the embodiments and certain modifications and equivalents thereof. Various features and aspects of the disclosed embodiments can be combined with or substituted for one another in order to form varying modes of the roof vent adaptors. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Some embodiments have been described in connection with the accompanying drawings. Some of the figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, the methods described herein may be practiced using any device suitable for performing the recited steps. The order in which the steps of the methods are described is not limiting, and other orders are contemplated.

In summary, various illustrative embodiments of roof vent adaptors have been disclosed. Although the roof vent adaptors have been disclosed in the context of those embodiments, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The following is claimed:

1. A roof vent adaptor configured to seal around a vent on the roof of a building, the roof vent adaptor comprising:

a flexible sealing member comprising a top, a bottom, an outer periphery, and an aperture having a border, the bottom of the sealing member configured to be adjacent to a roof surface;

an outer securing band positioned on the top of the sealing member and along the outer periphery of the sealing member; and an inner securing band positioned on the top of the sealing member and along the border of the aperture of the sealing member;

wherein the outer securing band and the inner securing band are configured to receive a plurality of fasteners therethrough and into the roof, such that the sealing member can be secured between the outer securing band and the roof and between the inner securing band and the roof.

2. The roof vent adaptor of claim 1, wherein the outer securing band and the inner securing band comprise a metal.

3. The roof vent adaptor of claim 1, wherein the outer securing band and the inner securing band have an annular shape.

4. The roof vent adaptor of claim 1, wherein the plurality of fasteners comprise screws, and wherein the outer securing band and the inner securing band are configured for the screws to be driven through the outer securing band and the inner securing band.

5. The roof vent adaptor of claim 1, wherein the sealing member comprises rubber.

6. The roof vent adaptor of claim 1, wherein the inner securing band comprises a plurality of metal strips that are arranged along the border of the aperture.

* * * * *